US011952694B2

(12) United States Patent
Ronchi

(10) Patent No.: US 11,952,694 B2
(45) Date of Patent: Apr. 9, 2024

(54) MULTIPURPOSE MACHINE AND METHODS FOR DYEING FABRICS AND WARP YARNS

(71) Applicant: MASTER S.R.L., Macherio (IT)

(72) Inventor: Francesco Ronchi, Sovico (IT)

(73) Assignee: MASTER S.R.L., Macherio (IT)

( * ) Notice: Subject to any disclaimer, the term of this patent is extended or adjusted under 35 U.S.C. 154(b) by 512 days.

(21) Appl. No.: 17/273,218

(22) PCT Filed: Jul. 29, 2019

(86) PCT No.: PCT/IB2019/056439
§ 371 (c)(1),
(2) Date: Mar. 3, 2021

(87) PCT Pub. No.: WO2020/053677
PCT Pub. Date: Mar. 19, 2020

(65) Prior Publication Data

US 2021/0189622 A1 Jun. 24, 2021

(30) Foreign Application Priority Data

Sep. 12, 2018 (IT) ..... 102018000008544

(51) Int. Cl.
*D06B 21/00* (2006.01)
*D06B 3/04* (2006.01)
(Continued)

(52) U.S. Cl.
CPC ..... *D06B 21/00* (2013.01); *D06B 3/04* (2013.01); *D06B 3/18* (2013.01); *D06B 3/32* (2013.01);
(Continued)

(58) Field of Classification Search
CPC ... D06B 3/04; D06B 3/18; D06B 3/32; D06B 19/0094; D06B 21/00; D06B 23/18; D06P 1/22; D06P 1/228
See application file for complete search history.

(56) References Cited

U.S. PATENT DOCUMENTS 5,337,586 A * 8/1994 Ronchi ..... D06B 3/04 68/5 D
5,922,084 A 7/1999 Fuchs et al.
(Continued)

FOREIGN PATENT DOCUMENTS

| | | | |
|---|---|---|---|
| DE | 4342313 | A1 | 6/1995 |
| GB | 1107035 | A | 3/1968 |
| WO | 2017208134 | A1 | 12/2017 |

*Primary Examiner* — Joseph L. Perrin
(74) *Attorney, Agent, or Firm* — Dickinson Wright PLLC; Andrew D. Dorisio

(57) ABSTRACT

A dyeing machine comprising at least one dyeing module in which a first squeezing device for a textile support, a first treatment tank, a central tank, a second treatment tank and a second squeezing device are located in sequence is described. The dyeing machine also includes a hydraulic system for feeding, circulating and alternately adjusting the levels of process fluids in the tanks. The tanks are preferably enclosed in a hermetically sealed upper covering shell. The two treatment tanks have the same shape, the same dimension and capacity characteristics, and are symmetrical with respect to a plane of symmetry lying in the central tank and arranged perpendicularly with respect to the direction of advance of the textile support. The dyeing machine is provided with means for moving the textile support, configured to advance the textile support alternately in both directions, i.e. either from the first squeezing device to the second squeezing device, sequentially through the tanks, or from the second squeezing device to the first squeezing device, again sequentially through the tanks.

15 Claims, 24 Drawing Sheets

(51) Int. Cl.

| | |
|---|---|
| ***D06B 3/18*** | (2006.01) |
| ***D06B 3/32*** | (2006.01) |
| ***D06B 19/00*** | (2006.01) |
| ***D06B 23/14*** | (2006.01) |
| ***D06B 23/18*** | (2006.01) |
| ***D06P 1/22*** | (2006.01) |

(52) U.S. Cl.
CPC ..... *D06B 19/0094* (2013.01); *D06B 23/14* (2013.01); *D06B 23/18* (2013.01); *D06P 1/22* (2013.01); *D06P 1/228* (2013.01)

(56) References Cited

U.S. PATENT DOCUMENTS

| | | | | |
|---|---|---|---|---|
| 6,355,073 | B1 | 3/2002 | Godau | |
| 2005/0028303 | A1 | 2/2005 | Wroblowski | |
| 2008/0040870 | A1* | 2/2008 | Ronchi | D06B 19/0076 8/151.2 |
| 2009/0000042 | A1* | 1/2009 | Ronchi | D06B 21/00 68/21 |
| 2009/0265867 | A1* | 10/2009 | Ronchi | D06B 21/00 8/477 |
| 2018/0142390 | A1* | 5/2018 | Ronchi | D06B 3/201 |

* cited by examiner

MULTIPURPOSE MACHINE AND METHODS FOR DYEING FABRICS AND WARP YARNS

FIELD OF THE INVENTION

The present invention generally relates to a multipurpose machine, for universal use and relative methods for dyeing woven fabrics, knitted fabrics and warp yarns with an alternating stages batch system and with any dye, in particular with indigo and other vat dyes in an inert environment. More specifically, the present invention relates to an extremely advantageous and economical multipurpose machine for the ecological dyeing of denim fabrics and clothing in general with indigo and other vat dyes, using low and/or high concentration baths and at low or high temperatures.

BACKGROUND

Denim is the particular fabric used to make jeans, which being produced in about five billion pairs annually make this fabric quantitatively the most used in the world. Jeans had their origin in California as a work garment for the masses. The next stages of their development took them to the east of the United States and then to Europe and the rest of the world. Workwear turned into leisurewear, and from then on has continued to evolve and be refined.

Jeans dominate and win over all other types of trousers, not only because of their practicality and availability in a wide range of qualities and prices, but above all for their symbolic value and for the aura of meaning they carry.

First of all, because of history: as a poor, rebellious, rough, male American garment, thus something free and brave, it's part of their folk memory. Then there is that particular blue: a colour that in Western culture speaks of optimism and calm, nobility and work. But in jeans there is a particular colouring, worked in such a way as to dye progressively, which can therefore be positively changed over time, unlike any other fabric, and thus inviting inscriptions, tears, discolouration, coloured patches and embroideries. Another important factor is the denim fabric: strong, tenacious, able to withstand any ill-treatment, but natural, yielding, able to adapt to the body, and also having memory.

The success of the combination of denim and blue jeans is due to the particular construction of this fabric, of which only the warp is dyed with indigo, while the weft is raw cotton. Indigo is one of the oldest dyes, not easy to apply to cotton, for which it has little affinity, but it has a unique characteristic that, after washing, makes the fabric and consequently the garment shiny and pleasing over time. As far as we aware, no other dye has this property. The above-mentioned special feature, together with the impression of a worn garment, which is highlighted by abrasion in the most exposed areas and which creates a plastic effect on the body of the wearer, is responsible for the charm of blue jeans, which are and will remain the most sold ready-made garment in the world, made and treated in many ways.

Unfortunately jeans have an unfortunate record throughout the clothing sector: that of the garment that gives rise to the worst environmental and social impact. The cycle for the creation of blue jeans, from the cultivation of cotton to the point of sale, requires very high consumption of water and energy, as well as the use of chemicals in different stages of production, which then end up in the environment or in contact with consumers.

One of the characteristics of indigo dye, which makes it unique, is the special method of dyeing required for its application to cotton yarn. Due to its relatively small molecule and low affinity for cellulose fibre, to be applied this dye not only must be chemically reduced in alkaline solution (leuco), but also needs to undergo a plurality of impregnations interspersed with wringing out and subsequent oxidation in air. In practice, a medium or dark colour shade is obtained only by subjecting the yarn to initial dyeing (impregnation, squeezing, oxidation) followed immediately by more over-dyeing steps, the more numerous of which the darker the shades and the higher the required colour-fastness.

This particular method of dyeing, typical of indigo dye, highlights the enormous importance of complying with certain basic parameters relating to dipping and oxidation times. This allows the dye to impregnate and be evenly distributed in the cortical or surface layer of the yarn ("ring dyeing") and, after being perfectly squeezed, to be completely oxidised before entering the next tank, so as to be able to "accumulate", i.e. intensify the colour shade. Unfortunately, in addition to these parameters, continuous dyeing with indigo is also influenced by many other factors relating to the different physical-chemical contexts of each individual dyeworks, as well as the environmental conditions where such plant is installed, such as the temperature and relative humidity of the air, windyness, altitude, etc. In addition, the different dyeing conditions (such as number of tanks, their capacity, pick-up, type and speed of circulation of the dye bath, type and precision of automatic dosing systems for indigo, sodium hydrosulphite and caustic soda, etc.) and the different dye bath conditions (such as temperature, concentration, pH, Redox potential, etc.) not only have a decisive influence on the results of dyeing (such as greater or lesser intensity of dyeing, fastness, depth of penetration, etc.), but also contribute significantly to determining the final appearance of jeans after the various washing and finishing treatments to which they are normally subjected. It should also be stated that, unlike other groups of dyes for which affinity for cotton increases with increasing temperature, for indigo, affinity and intensity of colour, the latter due to greater depth of penetration of the dye, increase with decreasing temperature.

It is therefore clear that the most important operation governing the entire production cycle of denim fabrics is the continuous dyeing of warp yarns with indigo dye and/or other vat dyes before they are placed in a loom for the production of fabric. Classic denim is in fact made by weaving pre-dyed cotton yarns. In particular, only the warp is dyed, while the weft is used untreated.

The continuous indigo dyeing of warps for denim fabrics is mainly carried out according to two systems, namely the so-called "rope" system and the so-called "loop" or "slasher" systems, in lines of considerable complexity, length and cost. The two systems mentioned above, although substantially different, in the case of indigo dyeing nevertheless have the same common feature—use of the same dyeing method, consisting essentially of three operational stages that are repeated several times: impregnation of the yarn with leuco, squeezing to eliminate the excess dye bath and oxidation of the dye by exposing the dyed yarn to air.

Typically and traditionally, in both the rope and slasher systems the indigo dyeing of warps for denim fabrics is carried out in open low-temperature tanks. In detail, in the two systems, the systems for the continuous dyeing with indigo normally comprise 3-4 pre-treatment tanks, 8-10 dyeing tanks and 3-4 final washing tanks. All the tanks are equipped with a squeezing unit to eliminate the excess dye and wash baths, while the dyeing tanks are also equipped with groups of rollers for oxidising the yarn in air.

The dyeing tanks are of an open type, each having a capacity ranging between 1,000 and 4,000 litres, drawing in about 4-11 metres of yarn. These quantities of dye bath determine the total volume of bath circulating in the plant, which can therefore vary from about 10,000 to 40,000 litres. The dye bath present in each tank is continuously recirculated to ensure uniformity of concentration in each tank. This recirculation is normally carried out by various known piping systems, with high-flow and low-head centrifugal pumps to avoid harmful turbulence. Movement of the dye bath causes the surface part of the bath itself, which is in contact with the air, to be continuously replaced. Moreover, as the tanks are open at the top, this movement of the dye bath causes oxidation. Oxidation of the dye bath results in continuous depletion of the reducing agents present in it, i.e. sodium hydrosulphite and caustic soda, said depletion increasing the higher the temperature of the dye bath.

However, it is the multiple oxidation stages that contribute much more than mentioned above to impoverishing these components (sodium hydrosulphite and caustic soda) in the dye bath with which the yarn is impregnated. These oxidation stages are an integral part of the dyeing cycle and in practice comprise exposing about 30-40 metres of yarn impregnated with leuco to air between one tank and another of the 8-10 dyeing tanks in the plant. Overall, the yarn is therefore exposed to air for several hundred metres throughout the dyeing plant.

On the basis of the above, there is a need to continuously replenish the dye bath with the quantities of sodium hydrosulphite and caustic soda destroyed by the above oxidations, so that the dye bath is constantly maintained under optimum chemical conditions for best dyeing performance and to guarantee constant and reproducible results. These continuous additions to the dye bath constitute a significant economic cost, increase the salinity of the dye bath itself, with consequent dyeing problems, and also give rise to significant pollution of the final wash water.

Of course dye must also be continuously and constantly added to the dye bath, in the concentrated leuco condition, in the quantities necessary to obtain the desired colour shade. Various systems can be used for the automatic continuous dosing of indigo dye, sodium hydrosulphite and caustic soda, such as dosing pumps, weighing systems, volumetric systems, weight-related systems, etc., all of which are in any case known as they are normally used in other textile processes. Logically, the larger the volume of the dye bath, the longer it will take to bring a new dye bath to the chemical/dye balance needed to achieve the same colour shade consistently. The response time to possible corrective measures will also be long, and this does not help achieve quality.

Another special feature of indigo dye is the fact that dye baths with this dye are never replaced, except to change the intensity of the dye. As already mentioned, indigo dye baths are instead continuously reused with the addition of sodium hydrosulphite, caustic soda and dye to maintain their chemical/dyeing balance constant. Each dyeing plant therefore has a particular number of containers with the total capacity of all the dyeing tanks, equal to the number of blue variants in production. These containers are used to store and reuse dye baths.

For qualitative purposes it is of the utmost importance to be able to maintain the physical-chemical conditions of the dye bath constant for as long as it takes to dye an entire batch of yarn. The average time is between 15 and 30 hours, depending on the length of the yarn and the dyeing rate. Unfortunately, despite continuous mechanical and hydraulic improvements to dyeing plants and the aid of sophisticated control and dosing systems, because of the large volumes involved, as well as the many causes described above which individually or in conjunction with each other can help to create undesirable changes in the conditions of the dye bath, continuous dyeing with indigo remains a complex operation. Of the various stages in the production cycle, the dyeing stage is therefore the one that predominantly contributes to determining the quality of the final fabric, its grading and therefore the higher or lower selling price.

In addition to the above, in the slasher dyeing system, the length of the yarn fed into the dyeing line, which can reach about 500-600 metres, makes it difficult to control the plant. In the slasher system there is also an economic disadvantage due to the quantity of yarn lost at each batch change. In this operating condition, in fact, all the amount of yarn constituting the tail of the batch, the dyeing of which is finished and which remains in the plant after it has stopped, must be considered lost, as it is not uniformly dyed. Similarly the same quantity of yarn that constitutes the start of the next batch and which, connected to the tail yarn, also replaces it in the draw-in to the dyeing plant (at low speed for technical and safety reasons), is not uniformly dyed and must therefore be disposed of.

Unfortunately, economic crises, great competition, various social, political and ecological problems, relocations of production, generational changes and changes in fashion, together with general impoverishment with a consequent reduction in purchasing power and other reasons, are contributing to an inevitable fall in income and therefore require substantial changes in the denim production chain. Moreover, identical jeans with a uniform appearance and without any particular need for finishing, contrast, etc., have become an important fashion product, which requires continuous diversification in the production of denim fabric, made in different weights, in different weaves, with yarns of various counts, cotton or blends and other fibres, in many shades of colour, etc. For these reasons denim producers are therefore forced not only to maximise and continuously diversify the number of fabric types on offer, but also to produce them faster, in ever shorter runs and at ever lower prices, with significant erosion of profitability.

Never before has innovation and cost reduction been more essential to maintain or gain market positions in the sector and to recover from competitive disadvantages in such a globalised context. These are innovations not so much in the product or the materials themselves, but in methods of production. Also, instead of the classic rhythm of work based on times and seasonal collections, new and fast operational flexibility is needed to adapt, in real time, to the ever increasing needs of the market, of fashion, etc. All this because the "brands" buying the fabric in turn want to avoid long delays between the presentation of collections and the delivery of ready-made garments at points of sale, as these long times may entail a series of errors in assessing the product, colours and trends, while it is essential to reach the market at the right time with the right product.

For denim producers the only way to lower costs and reduce delivery times to a minimum is to change part of their output into raw fabric, to be kept always ready in the warehouse so that they only have to finish it, dyeing it immediately from time to time in the lengths and colours expressly requested by customers. In the light of the above it is clear that denim producers are now faced with imperative economic and business needs to change the production system, to increase operational flexibility, to add the possibility of dyeing raw denim to shorten delivery times, reduce costs and waste, and to be able to recover defective batches, as well as to make innovations in their conventional dyeing machinery to reduce energy, water and chemical consumption, to minimize waste, in other words to do everything that can help the presentation of a new product, at a lower cost, more economically, but at the same time ecologically and respecting environmental sustainability, a subject of increasing attention throughout the world. With regard to ecology, an international law enforcing a reduction in consumption and compliance with specific rules for the protection of health and the environment is not unlikely; indeed it is now required, or considered hopefully to be close, by many consumer-protection bodies.

In the specific sector of the continuous dyeing of warps for denim fabrics with indigo, machines have already been developed to meet most of the above requirements. The dyeing machines operating in this new and original working condition, i.e. in an inert environment (e.g. due to the presence of nitrogen), make it possible to eliminate many of the problems of the traditional dyeing system, in comparison with which they have the advantage of not only being able to halve the number of dyeing tanks, but also of drastically reducing the consumption of caustic soda and sodium hydrosulphite (by 50% to 80%). Also, as there is better fixing of the dye to the yarn, there is also a significant saving of wash water. Furthermore, in an inert environment (e.g. under nitrogen) the chemical reduction of indigo is total and complete and the leuco is broken down into nanoscale particles that increase its dyeing capacity. This increased dyeing capacity of leuco permits better penetration and better fixing of the dye to the fibre in comparison with the traditional dyeing system, with advantageous dyeing results in terms of colour-fastness, intensity and brightness, differences that qualitatively improve the final fabric. Moreover, experience gained with the above new technology has shown that in dyeing with sulphur-based dyes, which is the most expensive in energy terms, in particular for black, there is a higher colour yield, which can be visually evaluated to be around 40%, with much better fixing and with better brightness compared to dyeing in traditional machines.

Dyeing machines according to the known art, operating in an inert environment, are described for example in U.S. Pat. No. 6,355,073 B1 and US 2005/028303 A1. Document GB 1,107,035 A describes a so-called "jigger" dyeing machine, the operation of which will be explained in more detail below.

To sum up, there are two major improvements to be made in the denim production sector. The first, the most useful and by now almost essential, is the possibility of having a new dyeing machine operating in both the traditional way and in accordance with the concept and all the advantages of dyeing machines operating in an inert, simple, practical and multi-purpose environment which, for a modest investment in comparison with traditional continuous dyeing lines with indigo and other vat dyes, can dye raw denim and even warp yarns in an alternating stage batch system, in an ecological and economic way. The second improvement would be to replace the present classic continuous dyeing lines for fabrics and warp yarns with indigo and other vat dyes in air, with new dyeing lines in an inert environment, with all the inherent economic, ecological and qualitative advantages.

Unfortunately, for the social and economic reasons already mentioned, it is very unlikely, if not impossible, that the approximately one thousand continuous lines for dyeing yarn fabrics and warps with indigo and other vat dyes in air that are in operation in the world, even if largely obsolete, but very large, very expensive and complex in terms of plant engineering, will be replaced in a reasonably short time with new lines operating in an inert environment, meeting current needs. And it is equally unlikely, if not impossible, that denim producers will consider installing special long, complex, demanding and above all expensive continuous dyeing lines, because of the new requirement of being able to dye only some of output reserved as raw fabrics. It is instead logical to think of meeting the urgent need to reduce costs and consumption, as well as increasing operational flexibility at the same time, with a much more concrete and feasible solution comprising placing a new fabric dyeing machine alongside their current continuous warp dyeing machines. This new dyeing machine will operate in batch mode in alternate stages, preferably in an inert environment, i.e. in an economic and ecological way. This new dyeing machine will be short, simple, practical and multipurpose, but above all considerably cheaper than a continuous dyeing line.

SUMMARY

The object of this invention is therefore to be able to provide both a machine and a multipurpose dyeing module with a system of alternating batch stages, using any dye, in particular indigo and other vat dyes in an inert environment, with a diversifiable structure, of universal application, which can be used independently, for dyeing raw ("ready to dye") fabrics, for dyeing any other woven and knitted fabric and also warp yarns, wound on any type of support or in appropriate containers. In particular the multipurpose dyeing module according to the present invention can be used independently for batch dyeing the increasingly requested small lengths of denim fabric with indigo and other vat dyes in alternating stages in an inert environment, for over-dyeing dyed denim and for dyeing woven and knitted fabrics and warp yarns. Alternatively, these fabrics may also be dyed with all other classes of dyes.

Another object of the present invention is to provide a multipurpose dyeing module that is able to operate in an inert environment, enabling a significant reduction in the normal consumption of sodium hydrosulphite and caustic soda in the batch dyeing of fabrics and warp yarns with indigo and other vat dyes.

Another object of the present invention is to provide a multipurpose dyeing module in an inert environment that enables fabrics and warp yarns to be dyed with indigo and other vat dyes in a discontinuous way, under the most technologically optimum conditions, and that enables diffusion and fixation of the dye to the fibre to be increased with a reduction in the consumption of wash water, so as to contribute to the sustainability of production.

These objects according to the present invention are accomplished by creating appropriate different versions of a multipurpose dyeing machine or module for universal use according to different needs, which can be matched to different demands, for the dyeing of woven and knitted fabrics and warp yarns, as set out in claim 1.

Further features of the invention are revealed by the dependent claims, which are an integral part of this description.

For denim producers the availability of this new multipurpose dyeing machine would enable them to reduce the normal quantity of finished denim fabric stored in the warehouse (which with changing fashion is likely to quickly become unsaleable, except through a significant price reduction), replacing it with an equal quantity of raw denim, and as a consequence to achieve:

- simplification of the production programme;
- facilitation of the sales service;
- fast deliveries in the lengths and colours expressly requested;
- elimination of waste (if offcuts are used);
- maximum production versatility, with the advantages of:

- ecological and economic dyeing, of inimitable quality, with a reduction in costs and in the consumption of chemicals and water;
- possibly improving the finished denim, with over-dyeing for special effects;
- possibly recovering defective and/or unsold fabric by means of over-dyeing;
- possibly dyeing very light denims, the warps of which are made up of a large number of very fine yarns, which are difficult to dye with traditional machines;
- the possibility of many alternations of dyeing with a bath having a low concentration of indigo for very dark colour shades and exceptional fastness ("Japanese denim");
- the possibility of cheap denim dyeing for low cost, non-fashion work jeans.

The multipurpose dyeing machine according to the present invention is the result of a combination between the dyeing process in an inert environment, reworking of the more than one-hundred-year-old conventional fabric dyeing technology on a "jigger", with which it only shares the fact of having a similar alternating movement of the fabric, and the particular system of feeding/circulating/dosing the bath typical of continuous lines for dyeing with indigo and other vat dyes.

The "jigger" is in principle a "roll to roll" machine, i.e. a machine where the fabric processed unrolls from one roll to wind onto another roll, with the actual processing taking place between the two rolls. This machine comprises two winder/unwinder rolls, the distance between centres of which determines the maximum winding diameter of the fabric, placed on top of a small tank with a short length drawn in. The fabric to be processed is initially wound onto one of the two rolls and then passed through the dye bath several times, slashing, unrolling and rewinding onto the other roll and then vice versa, an operation that is carried out in contact with the air. After dyeing the fabric is washed in the same number of steps to eliminate any excess unfixed dye. Finally, the fabric has to be unloaded from the machine and dewatered to eliminate excess water, and then proceeds to the subsequent processes of drying and finishing.

Substantially the multipurpose dyeing machine according to the present invention comprises a number of known elements placed upstream or downstream of an original and new multipurpose module of universal applicability for dyeing fabrics of all kinds, as well as warp yarns, with indigo and other vat dyes in an inert environment through a batch system with alternating stages. In practice the operation of this new machine comprises unwinding the fabric, preferably already prepared for dyeing, from a first roll, passing it through the multipurpose dyeing module in the prescribed manner and, after oxidising it, rolling it up onto the second winder and then possibly repeating the operating cycle in the opposite direction for the number of times necessary to obtain the required result.

The multipurpose dyeing machine according to the present invention differs substantially from a "jigger" in many aspects, in design, construction and operation, as well as in that it works in an inert environment. Dyeing with indigo and other vat dyes in an inert environment is ecological and economic, as it enables production costs to be reduced through saving time, energy, chemicals and water, as well as through greater functional flexibility, also ensuring results of unparalleled quality, with a high degree of dye penetration and fixation which is unattainable in traditional air dyeing. Like the known type of machines operating in an inert environment, this machine can work with low and/or high temperature baths and also with low and/or high concentrations of dye, a characteristic that helps to determine the number of dyeing stages and therefore the variations in production capability. It should be noted that in addition to use in the important sector of fabric dyeing this machine also adds the possibility of use for dyeing small batches of warp yarn that may be dried if necessary and in any case sized separately.

It should be noted that, with regard to warp yarn dyeing alone, this new machine can also be supplemented with at least two additional motorised stations (one on the right and one on the left) for winding/unwinding another two rolls of warp yarn, so as to be able to dye two warps at the same time, one overlapping the other. This particular working arrangement not only doubles production capacity, but also increases quality since the greater compactness of the yarn belt allows more efficient and uniform squeezing, with consequent elimination of the problematic defective dyeing between the centre and the selvedges.

The construction of the multipurpose dyeing machine according to the present invention is simple, economical, rational and functional. This machine is of universal application and adds the new dyeing technology in an inert environment, with all its strengths and advantages, to the possible traditional dyeing technology of fabrics and warps with indigo and other vat dyes in air. All this without the consumption of inert gas during the operating stages, but only in the initial stage of inerting. It should be noted that the special construction and functional feature of this machine, apart from operating in an inert environment, comprises being able to perform several consecutive dyeing operations with indigo, as in traditional continuous dyeing machines, so that the dye can accumulate to achieve darker colour shades and greater colour-fastness, operations that are not possible with the traditional "jigger", as the "jigger" has no intermediate squeezing and oxidation systems between one dyeing operation and the next. Specifically, this is a new machine that helps to make batch dyeing of fabrics and warps with indigo and other vat dyes undoubtedly the most responsive to all current and future technological and economic needs, as well as the greatest requirements for environmental sustainability. It should also be noted that this machine is the shortest ever machine for dyeing fabrics and warps with indigo and other vat dyes.

BRIEF DESCRIPTION OF THE DRAWING FIGURES

The characteristics and advantages of a machine for the batch dyeing of fabrics and yarns, using alternating stages and any dye, in particular in an inert environment and with indigo and other vat dyes, according to the present invention will be more apparent from the following description by way of example and without limitation, with reference to the attached diagrammatical drawings in which:

FIGS. 1H and 1I are diagrammatical views of the machine in FIG. 1A, but without the two groups of oxidising rolls;

Figure 11:
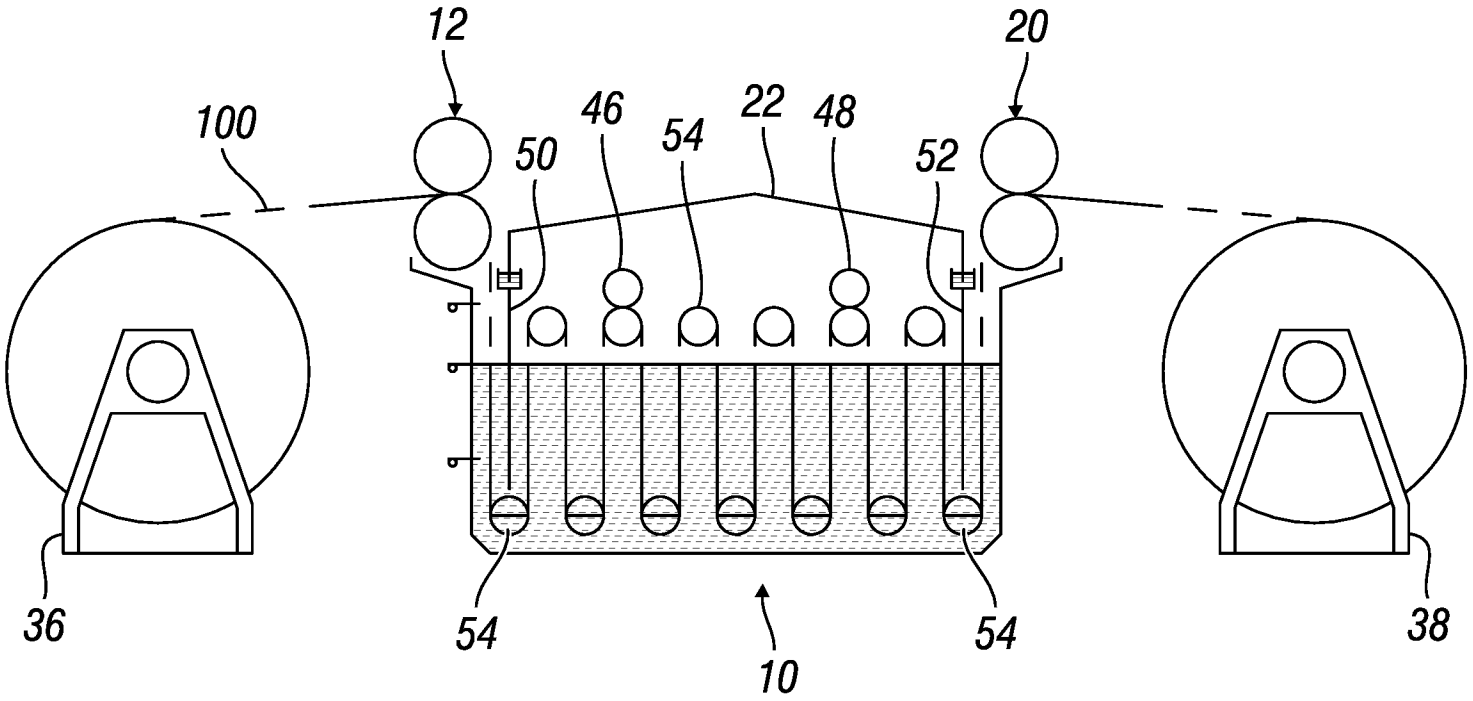
Figure 2:
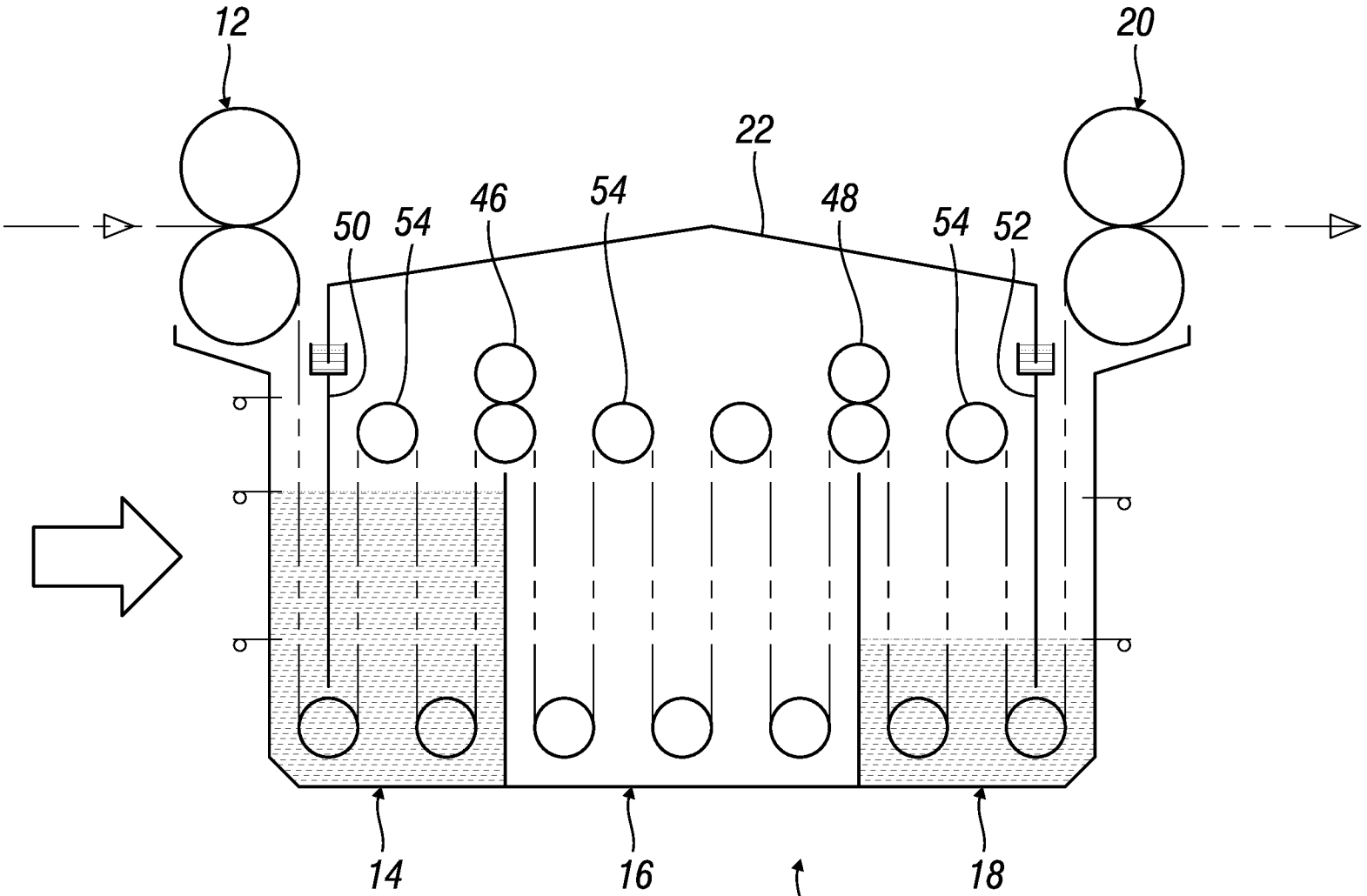
FIG. 2 is a diagrammatical side view in elevation of a single multipurpose module of universal application for dyeing fabrics of all kinds, including warp yarns, in an inert environment with an alternating stage batch system, in the preferred operating version for dyeing with indigo, in the stage in which the textile support is advancing from left to right.
Figure 3:
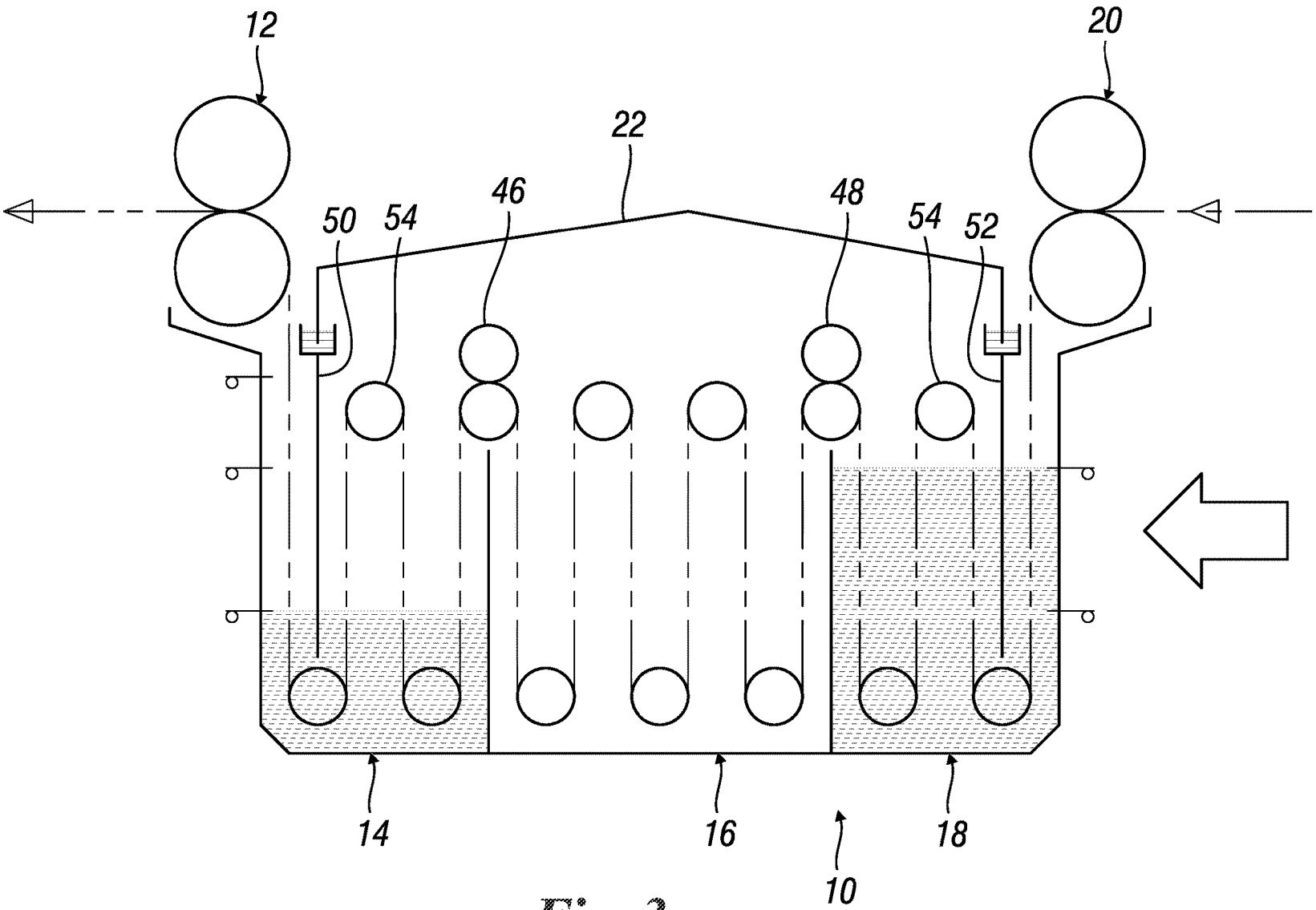
FIG. 3 is the same diagrammatical view as in FIG. 2, in the preferred operating version for indigo dyeing, but in the stage in which the textile support is advancing from right to left.
Figure 4:
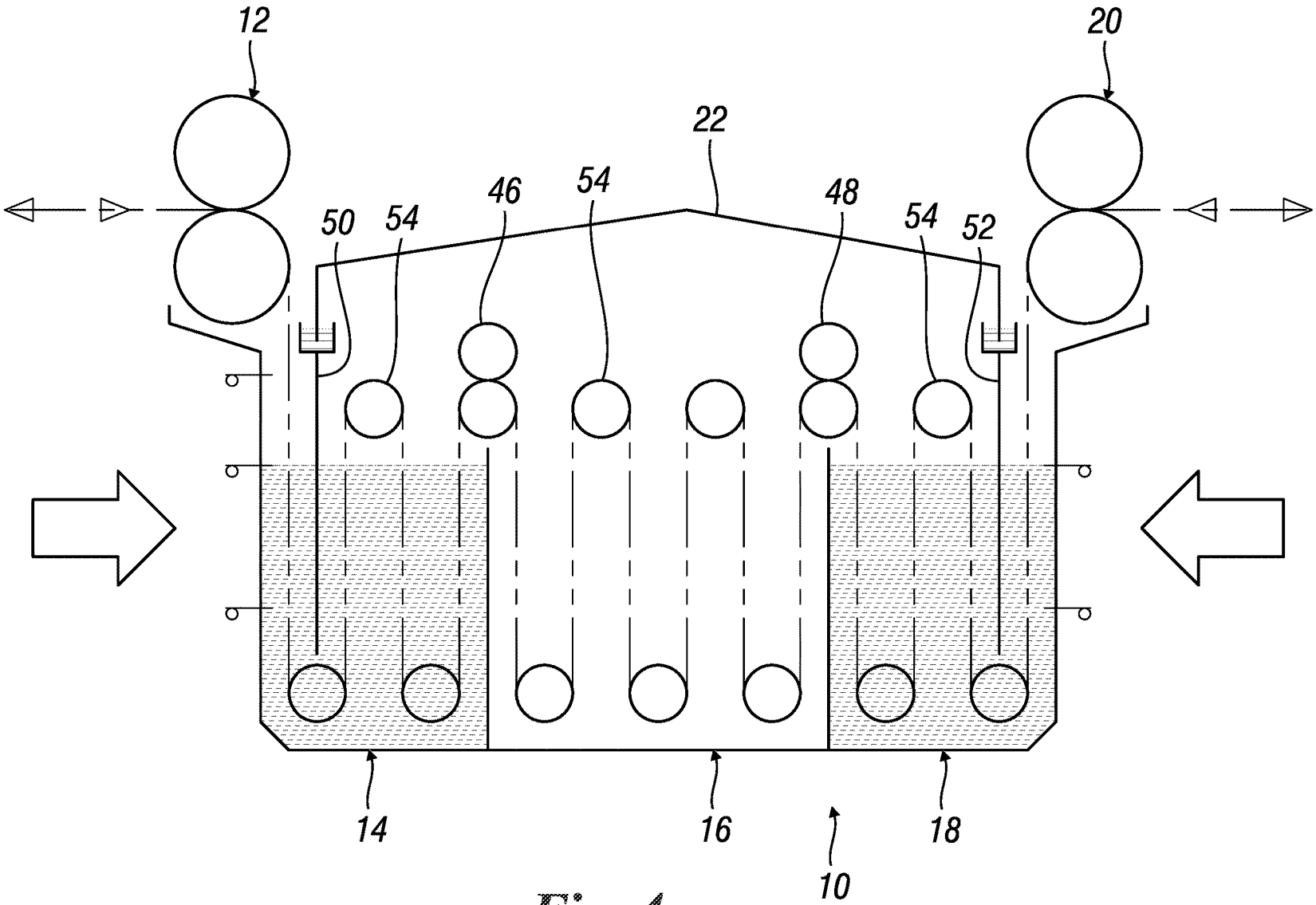
FIG. 4 is the same diagrammatical figure as in FIGS. 2 and 3, but in the preferential operating version for dyeing with sulphur-based dyes and in the stages in which the fabric/yarn is advancing both from left to right and from right to left.
Figure 5:
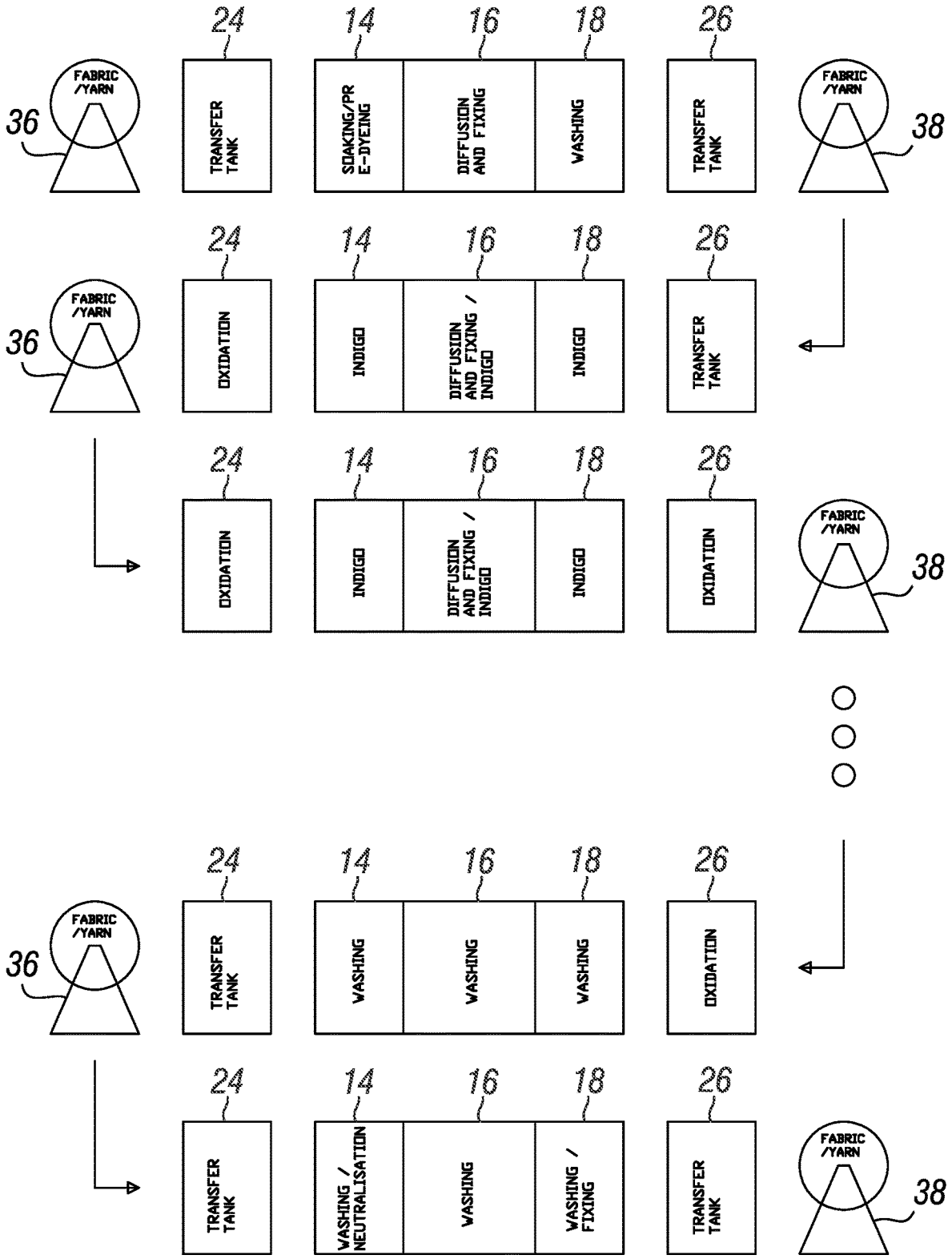
Figure 6:
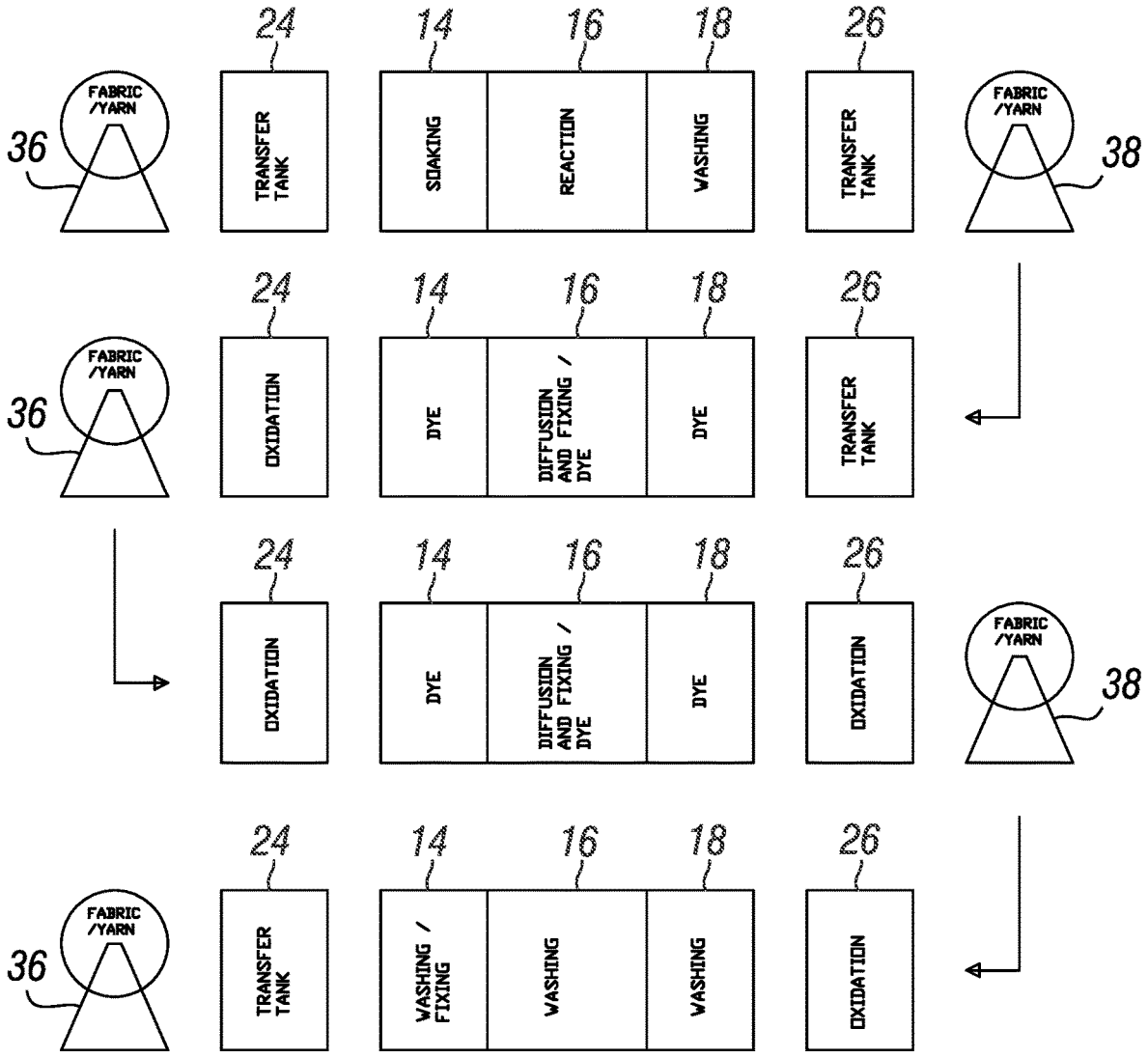
Figure 7:
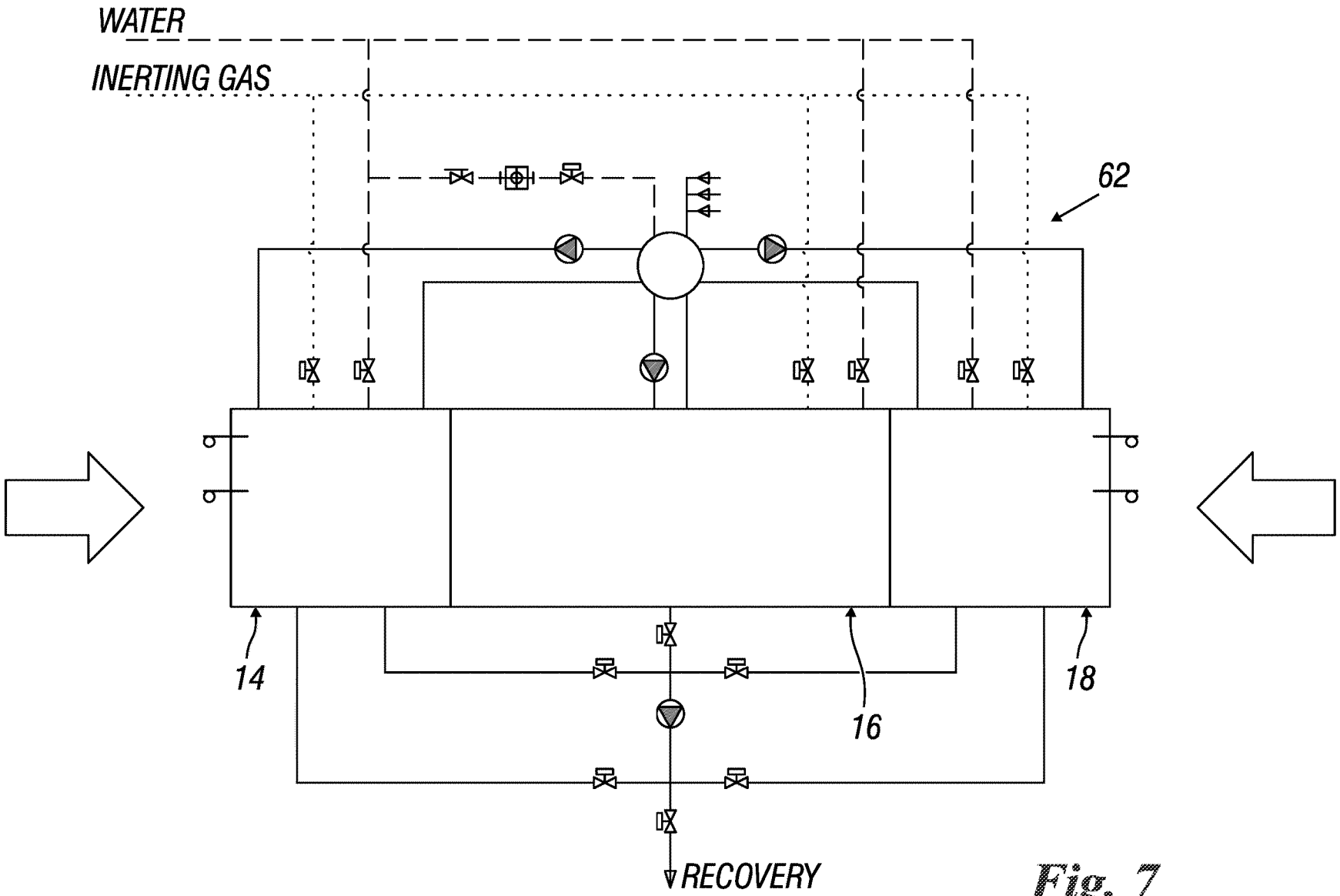
Figure 8A:
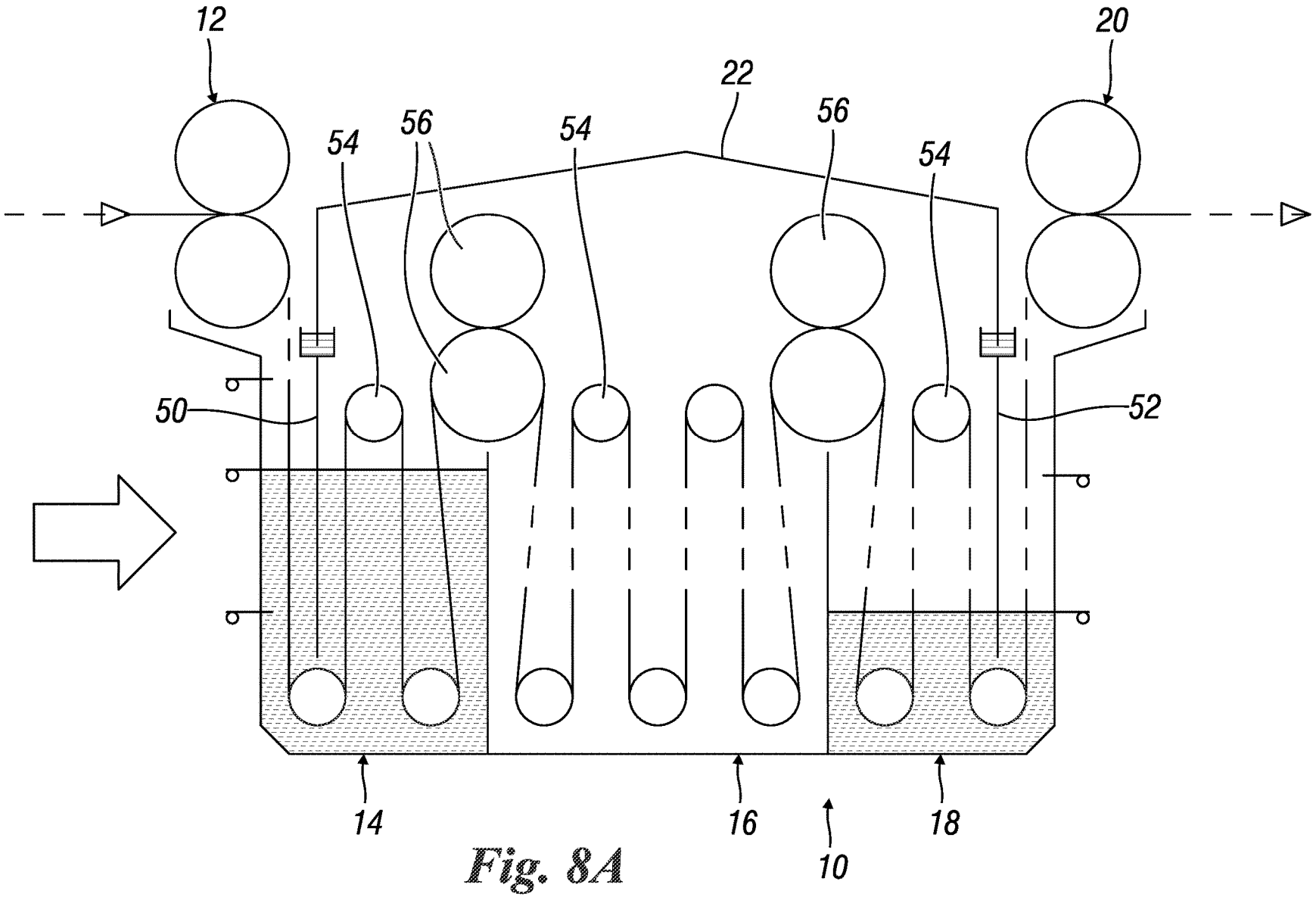
Figure 8B:
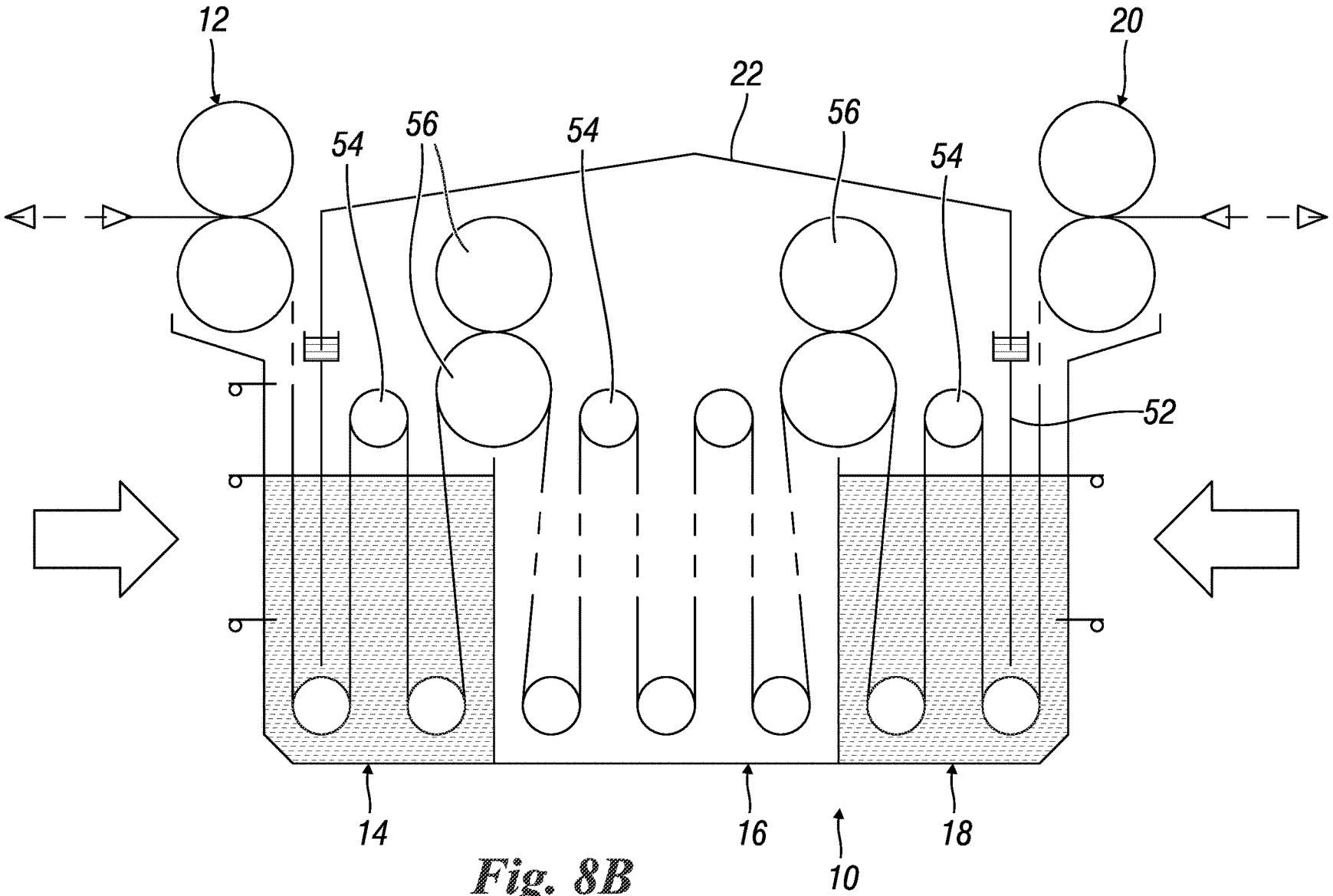
Figure 8C:
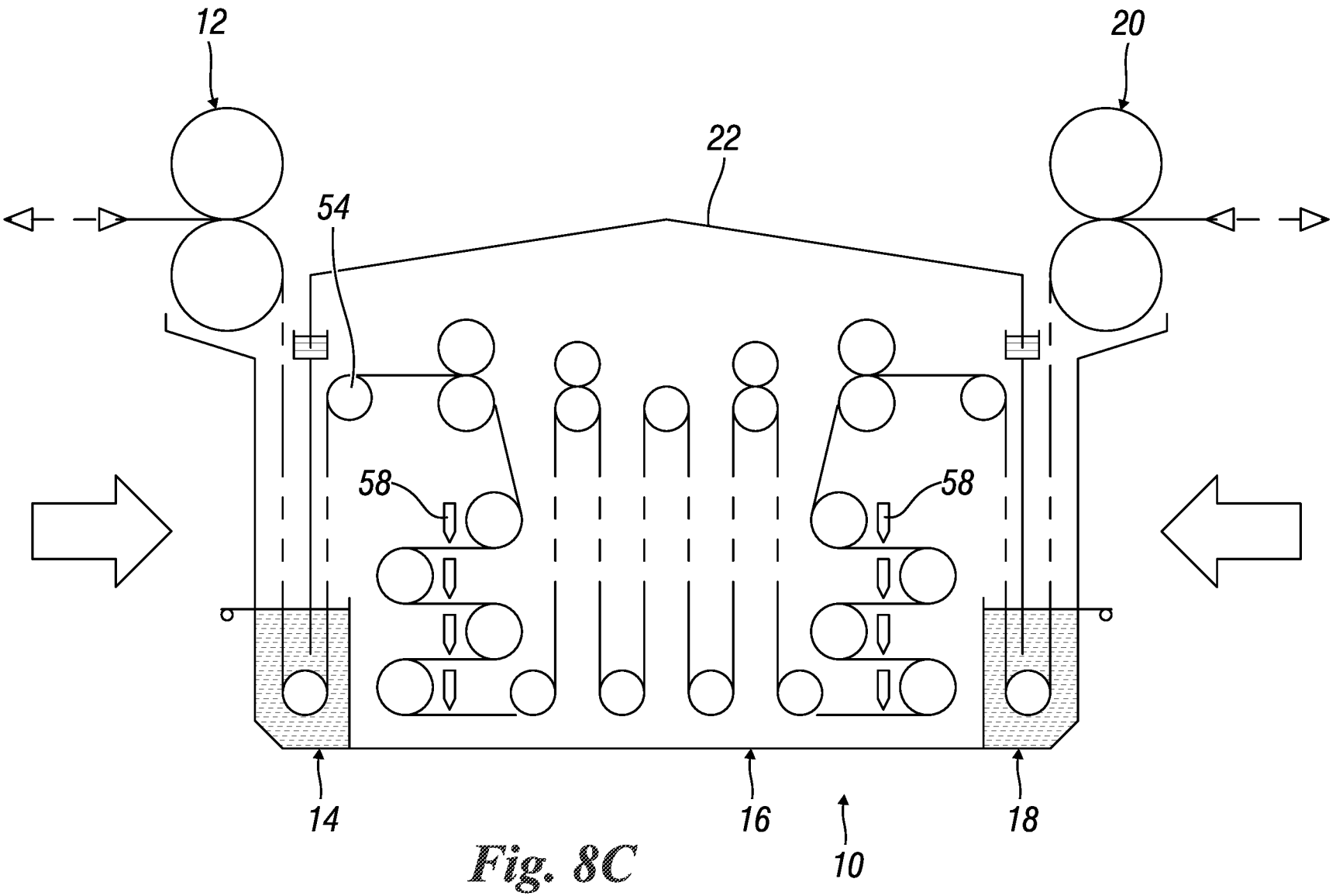
Figure 9:
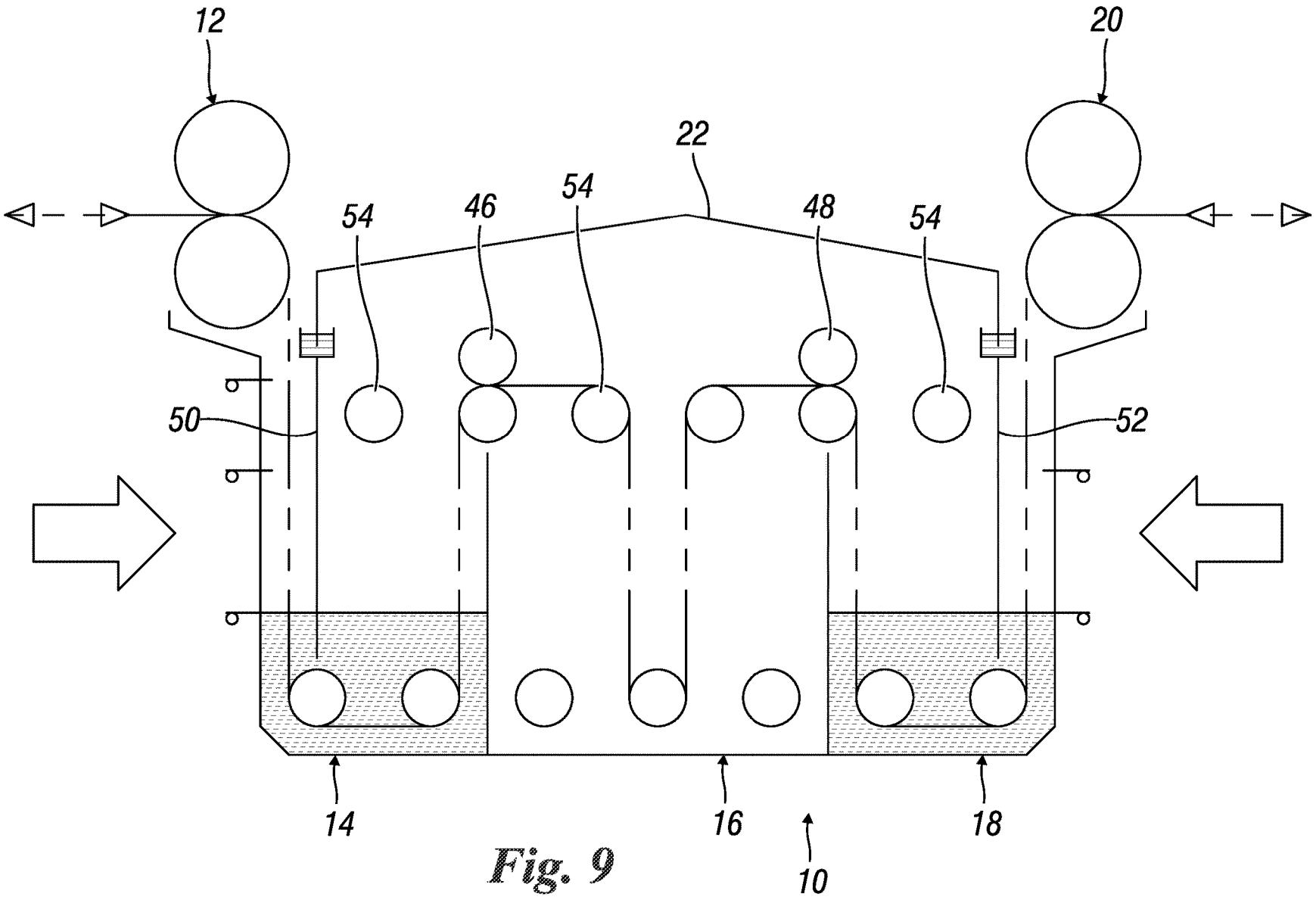
Figure 10:
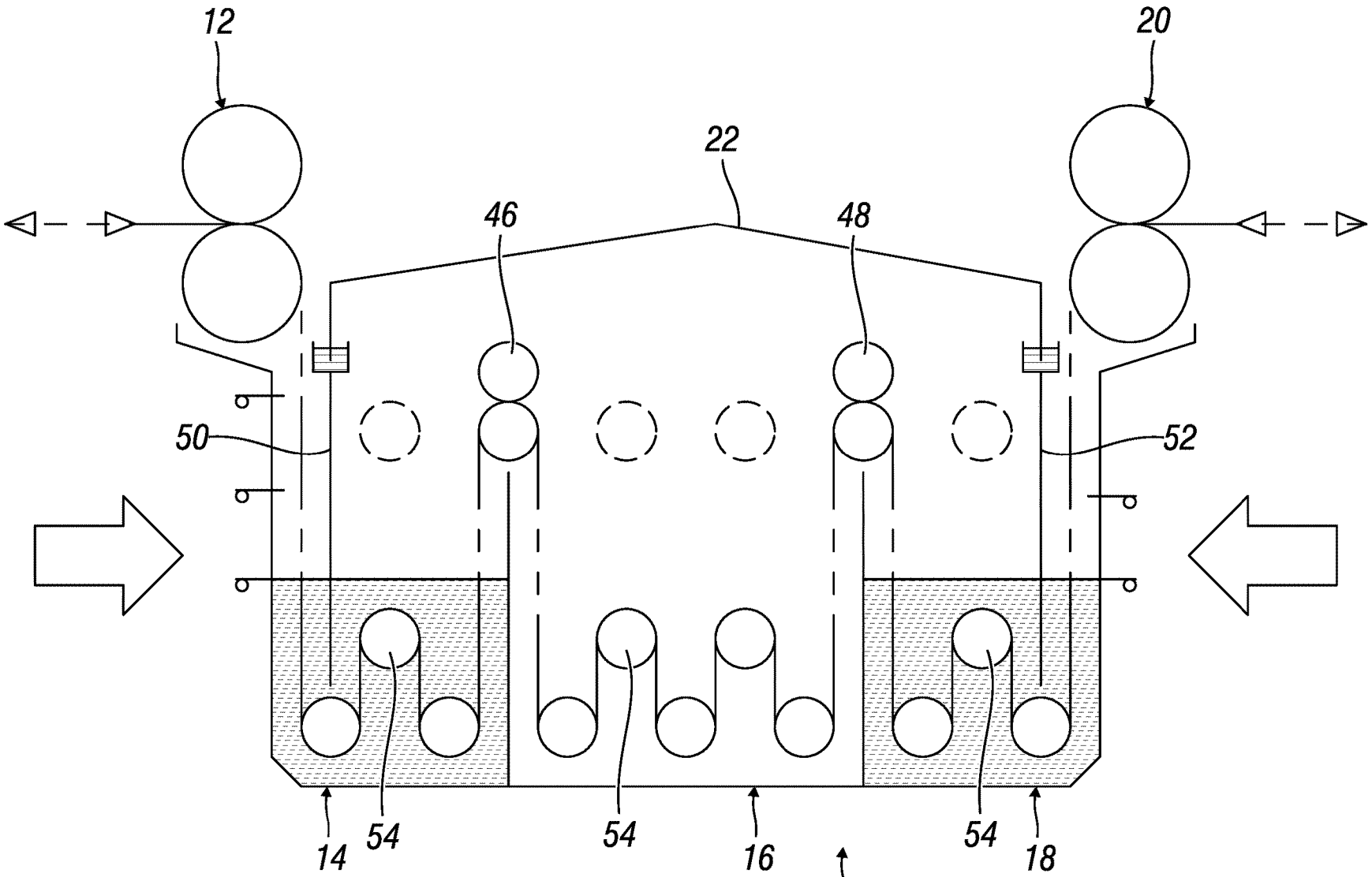
Figure 11:
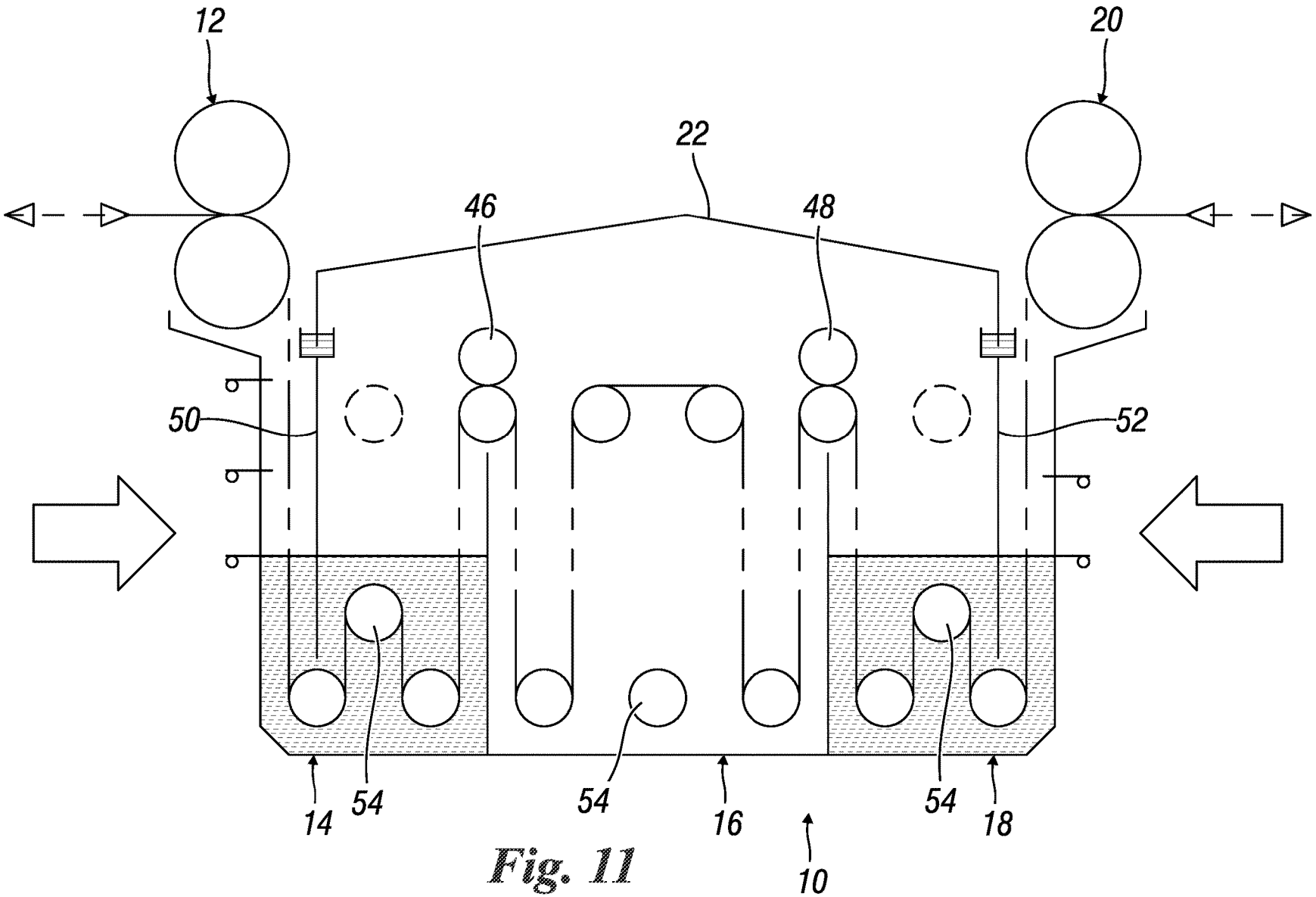
Figure 12:
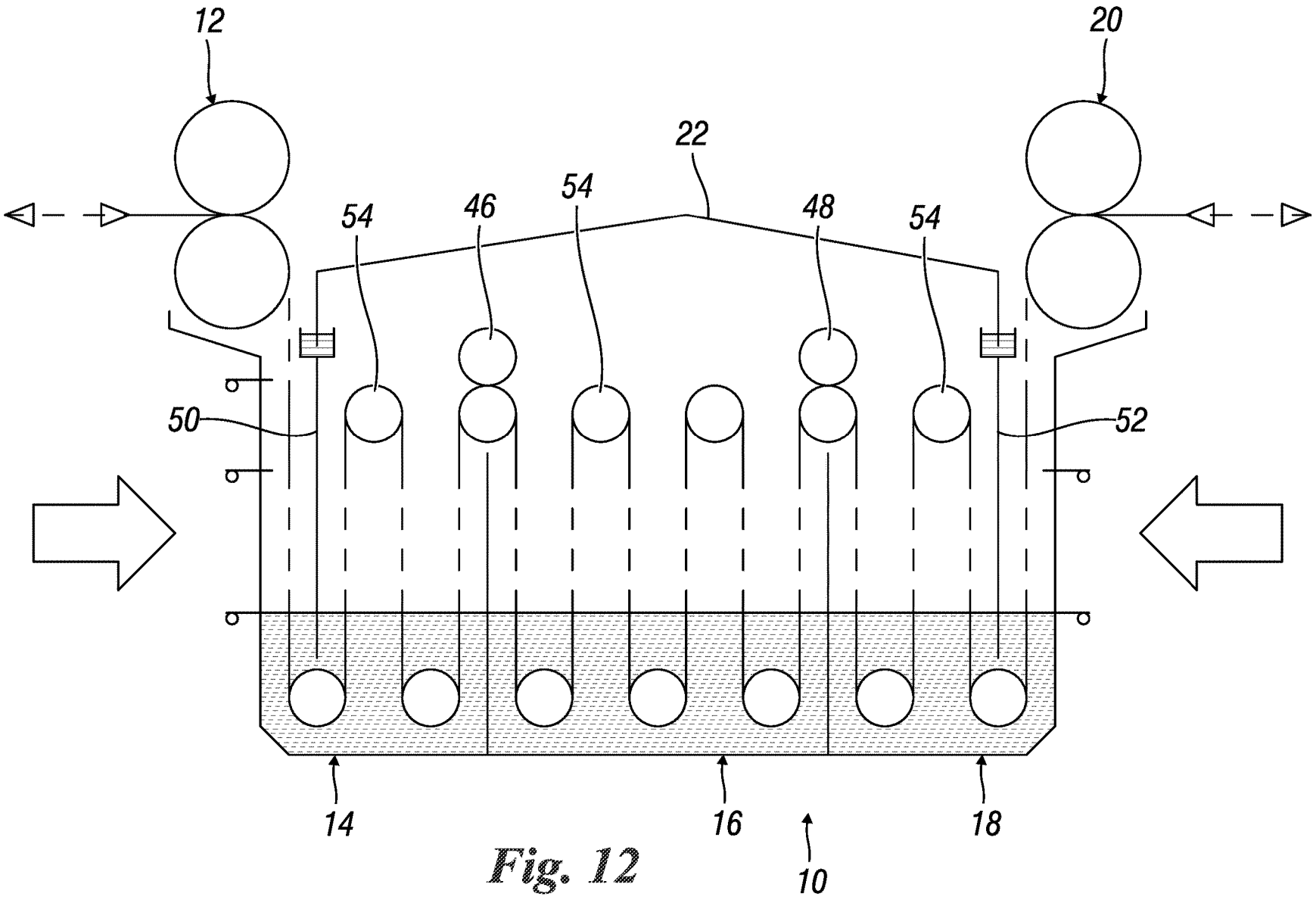

FIG. 5 graphically represents an indicative method for a possible operating cycle for dyeing with indigo, with the individual tanks used in a variety of different ways;

FIG. 6 graphically represents an indicative method for a possible operating cycle for dyeing with sulphur-based dyes, with the individual tanks used in a variety of different ways;

FIG. 7 shows a simplified functional diagram of the hydraulic system in the multipurpose dyeing machine;

FIGS. 8A and 8B show respectively, in diagrammatical side view in elevation, a module as shown in FIGS. 2, 3 and 4 in an alternative version, with the two internal weight-loaded idling rotating squeezers replaced by two pneumatic-pressure motorised squeezers 56, respectively in the preferred operating version for dyeing with indigo and sulphur-based dyestuffs;

FIG. 8C is a diagrammatical side view in elevation of a dyeing module as shown in FIGS. 8A and 8B in another alternative form of construction which provides for one of the possible special ways of drawing in the treated textile support so that it can be sprayed both on the face and reverse side, preferably from dispensers of foam dye solutions;

FIG. 9 shows, in diagrammatical side view in elevation, a dyeing module as shown in FIGS. 2, 3 and 4 in another alternative form of use with indigo dye, that is with reduced dipping and diffusion/fixing times, by means of a change in drawing-in;

FIG. 10 is a diagrammatical side view in elevation of a dyeing module as shown in FIGS. 2, 3 and 4 in another alternative form of use with indigo dye, that is with reduced dipping and diffusion/fixing times, obtained by lowering the upper rolls, without changing the draw-in;

FIG. 11 is a diagrammatical side view in elevation of a dyeing module as shown in FIGS. 2, 3 and 4 in another alternative form for use with indigo dye, that is with reduced dipping and diffusion/fixing times, obtained either by lowering the upper rolls or by changing the drawing-in; and FIG. 12 is a diagrammatical side view in elevation of a dyeing module as shown in FIGS. 2, 3 and 4 in another alternative form for use with indigo dye, where the dyeing takes place, preferably at a low level, in all three tanks.

DETAILED DESCRIPTION

It should be noted that the following description and the attached figures do not illustrate many components, accessories and instrumentation normally supplied for this type of dyeing machine, such as devices for spreading and guiding fabrics, inerting, feeding, unloading, heating, automatic dosing, level adjustments, etc., as these are well known to those skilled in the art.

A multipurpose dyeing machine according to the present invention is shown with reference to the figures. The dyeing machine comprises in sequence at least one dyeing module 10 within which the following components are present in sequence:

- a first squeezing device 12 for a textile support 100 entering the dyeing module 10, the first squeezing device 12 being configured to extract excess liquids from such textile support 100. It should be noted that the textile support 100 may comprise either a fabric or a yarn;
- a first multipurpose treatment tank 14, typically comprising a dyeing tank, for the textile support 100 coming from such first squeezing device 12. The first treatment tank 14 is located downstream of the first squeezing device 12 and is configured to be at least partly filled with a first process fluid;
- a central multipurpose tank 16, located downstream of the first treatment tank 14 and intended to contain the first process fluid or a second process fluid, for example nitrogen, to prevent oxidation of the textile support 100 when dyeing with diffusion/fixing of the dye in the fibre of this dyed textile support 100, or to function in the air to oxidise the dyed textile support 100;
- a second multipurpose treatment tank 18, typically comprising a dyeing tank, for the textile support 100. The second treatment tank 18 is located downstream of the central tank 16 and is configured to be at least partly filled with the same first process fluid as fills the first treatment tank 14, or another fluid;
- a second squeezing device 20 for such textile support 100, located downstream of the second treatment tank 18 and configured to extract excess liquids from such textile support 100; and
- a hydraulic system 62 to supply and circulate the first process fluid and/or the second process fluid respectively in the two treatment tanks 14, 18 and/or the central tank 16, as well as for alternating adjustment of the levels of the first process fluid and/or the second process fluid respectively in the two treatment tanks 14, 18 and/or the central tank 16.

The first treatment tank 14, the central tank 16 and the second treatment tank 18 are preferably enclosed by a hermetically sealed covering shell 22, located above the dyeing module 10. The first treatment tank 14 and the second treatment tank 18 have preferably the same shape and the same dimensional and capacity characteristics. In addition, the first treatment tank 14 and the second treatment tank 18 are preferably symmetrical to a plane of symmetry P lying in the central tank 16 and arranged perpendicularly to the direction of the forward movement of the textile support 100. The dyeing machine is therefore equipped with moving means configured to move the textile support 100 forward alternately in both directions, that is either from the first squeezing device 12 to the second squeezing device 20 sequentially through the first treatment tank 14, the central tank 16 and the second treatment tank 18, or from the second squeezing device 20 to the first treatment tank 12 sequentially through the second treatment tank 18, the central tank 16 and the first treatment tank 14.

Figure 1A:
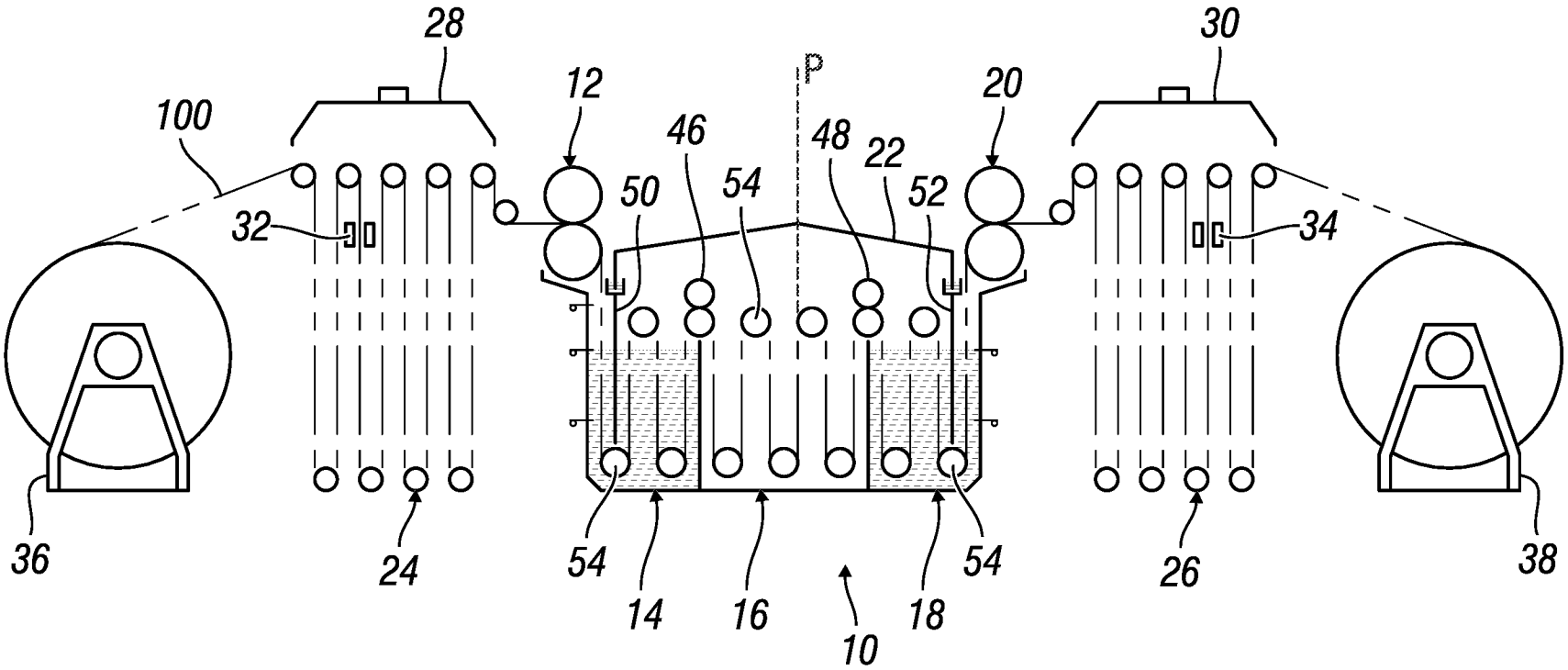
FIG. 1A is a diagrammatical side view in elevation of a multipurpose machine for dyeing a textile support typically comprising fabrics or warp yarns with indigo and other vat dyes in an alternating stage batch system in an inert environment.

In the embodiment in FIG. 1A the dyeing machine is set up for dyeing fabrics and warp yarns in a batch system with alternate stages, preferably in an inert environment, with indigo and other vat dyes. The dyeing machine is therefore equipped with at least one group of rolls 24, 26 for oxidation of the vat dyes in air on each of the two inlet/outlet sides and vice versa for the textile support 100 with respect to the dyeing module 10. In particular there is at least one group of oxidation rolls 24 located at the first squeezing device 12 and at least one second group of oxidation rolls 26 located at the second squeezing device 20. Each group of rolls 24, 26 can be equipped with at least one corresponding suction hood 28, 30 above them. Each group of rolls 24 may also be equipped with at least one respective oxidation intensifier device 32, 34.

The means for moving the textile support 100 may comprise at least one pair of motorised stations 36, 38 for controlled winding/unwinding of the fabric or yarn 100 onto/off the respective rolls. In particular, with reference to the embodiment in FIG. 1A, at least one first motorised winding/unwinding station 36 is located at the first group of oxidation rolls 24 in a position opposite to the position of the first squeezing device 12, while at least one second motorised winding/unwinding station 38 is located at the second group of oxidation rolls 26 in a position opposite to the position of the second squeezing device 20. With reference to the embodiment in FIG. 1B, there are at least two first motorised winding/unwinding stations 36, both located at the first group of oxidation rolls 24 and in a position opposite to the position of the first squeezing device 12, and at least two second motorised winding/unwinding stations 38, both located at the second group of oxidation rolls 26 and in a position opposite to the position of the second squeezing device 20. Moreover, with reference to the embodiment in FIG. 1C, the dyeing machine according to the present invention can be equipped with a system 60 to recirculate the textile support 100 which provides means to achieve looping of this textile support 100 in two or more overlapping layers. In this configuration the dyeing machine therefore operates as in the so-called "loop" system, with the advantage of increasing production capacity.

Each of the first treatment tank 14, the central tank 16 and the second treatment tank 18 is internally equipped with a plurality of return rollers 54, configured to position the textile support 100, which is in discontinuous movement, in a plurality of vertical planes parallel to each other. In particular at least some of these return rollers 54 can be moved in a vertical direction to change the way the textile support 100 is drawn into the dyeing module 10, as will be more particularly specified below.

Figure 1B:
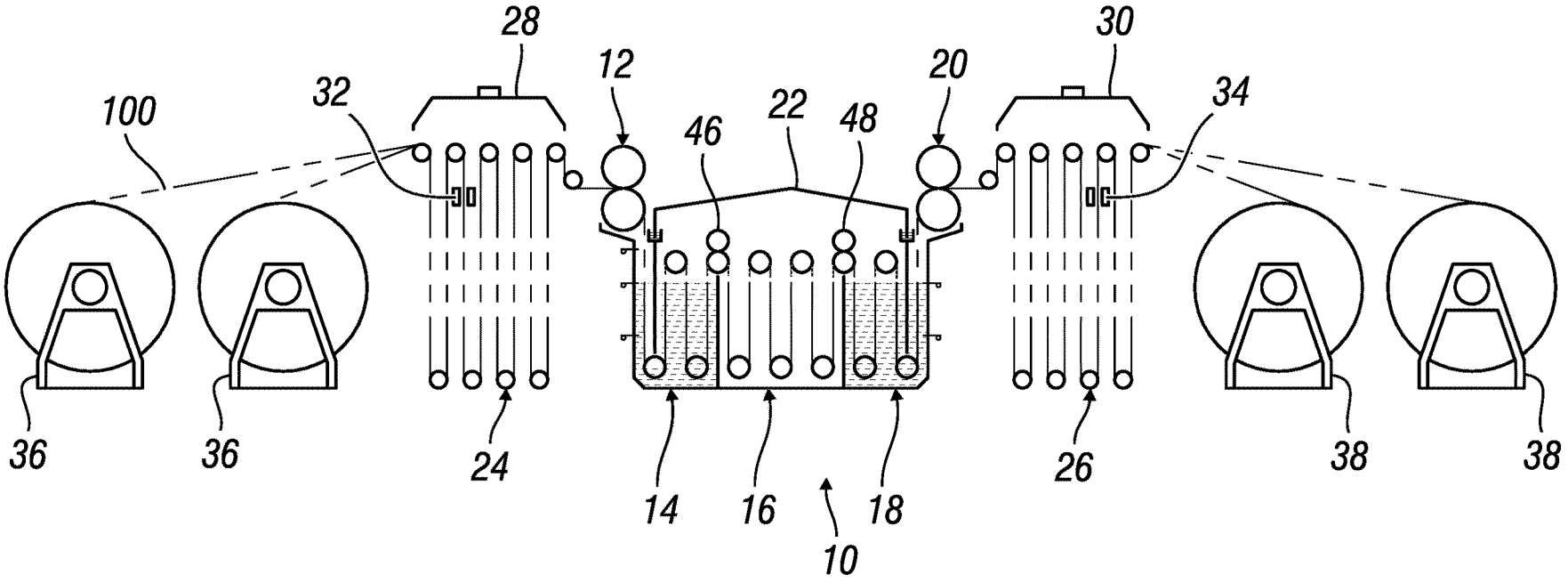
FIG. 1B is a diagrammatical view of the machine in FIG. 1A, but with at least one pair of textile support winding/unwinding stations on each side.
Figure 1C:
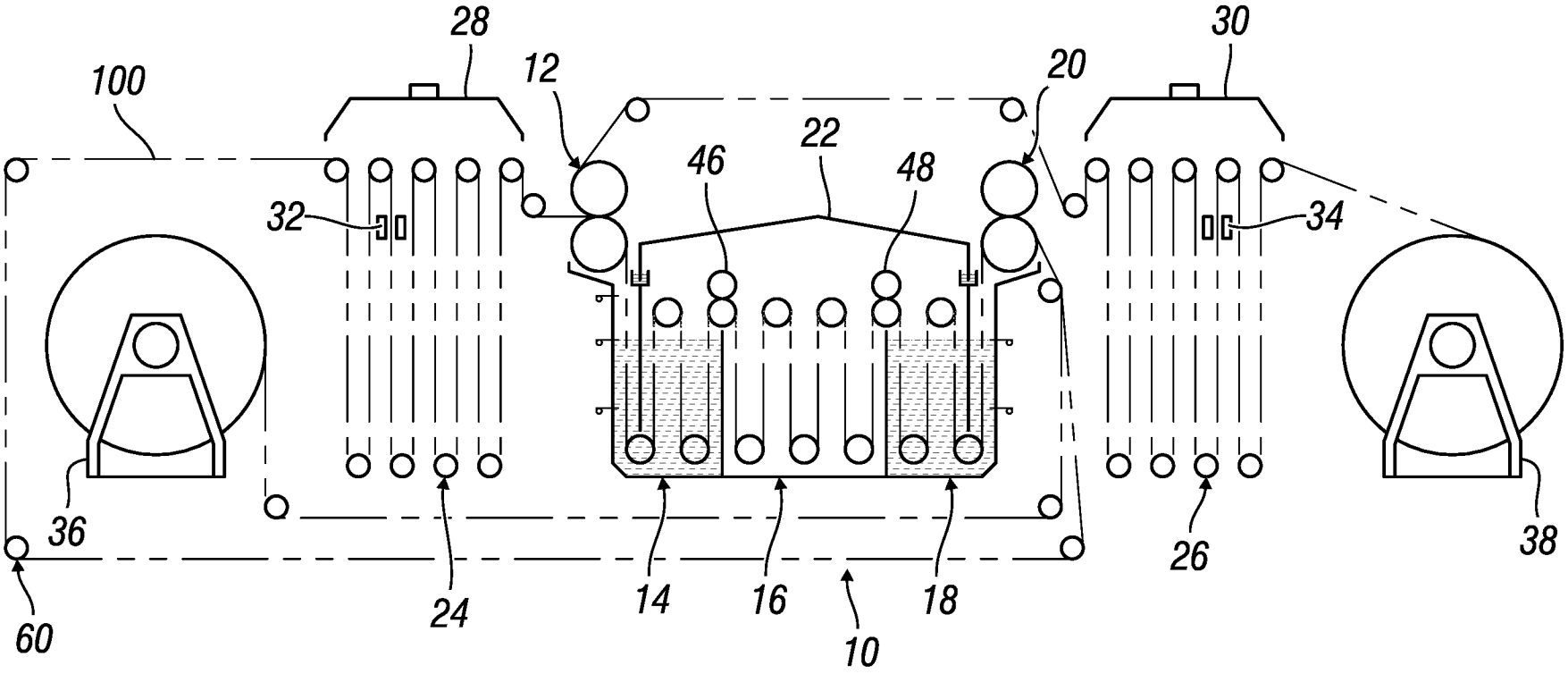
FIG. 1C is a diagrammatical view of the machine in FIG. 1A, in which the textile support is immersed so as to operate with more layers superimposed, that is in the "loop" system.
Figure 1D:
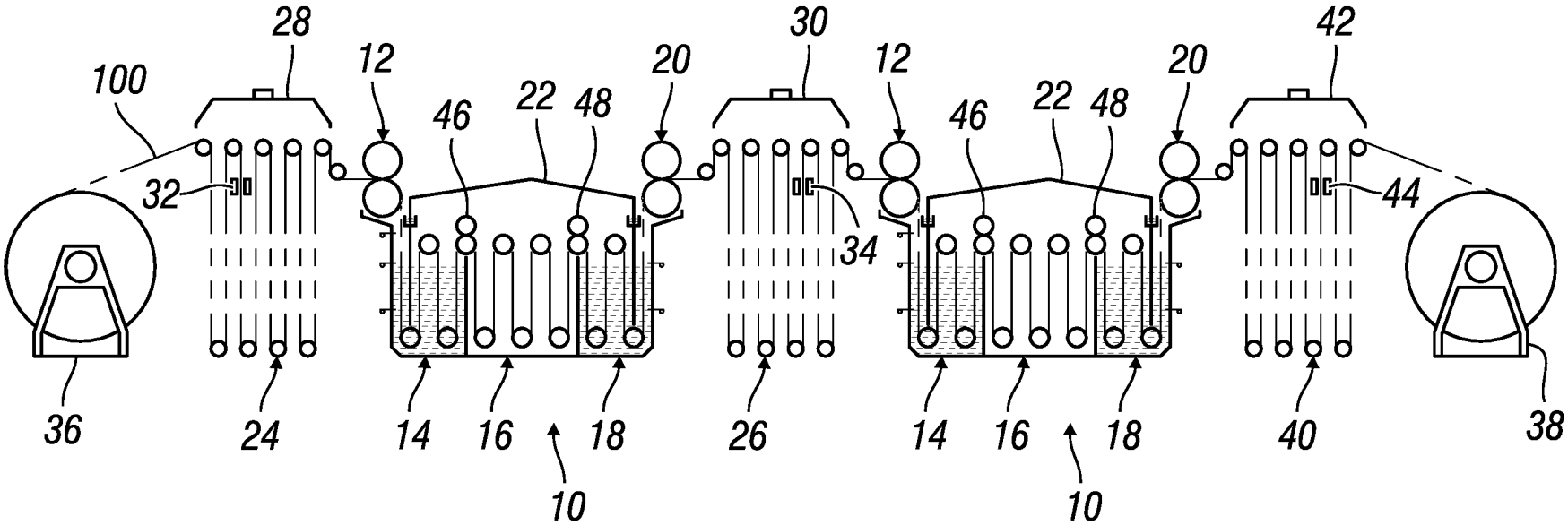
FIG. 1D is a diagrammatical view of the machine in FIG. 1A, but equipped with a pair of multipurpose dyeing modules arranged in line.

In the embodiment in FIG. 1D the multipurpose dyeing machine comprises in sequence:

- at least one first motorised winding/unwinding station 36 for the rolls for fabric or yarns 100;
- at least one first group of oxidation rolls 24, preferably equipped with a corresponding suction hood 28 and a corresponding oxidation intensifier device 32;
- a first dyeing module 10;
- at least one second group of oxidation rolls 26, preferably equipped with a corresponding suction hood 30 and a corresponding oxidation intensifier device 34;
- a second dyeing module 10;
- at least one third group of oxidation rolls 40, preferably equipped with a corresponding suction hood 42 and a corresponding oxidation intensifier device 44; and
- at least one second motorised winding/unwinding station 38 for the rolls for fabric or yarns 100.

This embodiment, having one more multipurpose dyeing module 10 than the previous embodiments in FIGS. 1A and 1B, has only the advantage of halving the number of dyeing alternations with the same result and therefore almost doubling production capacity.

Figure 1E:
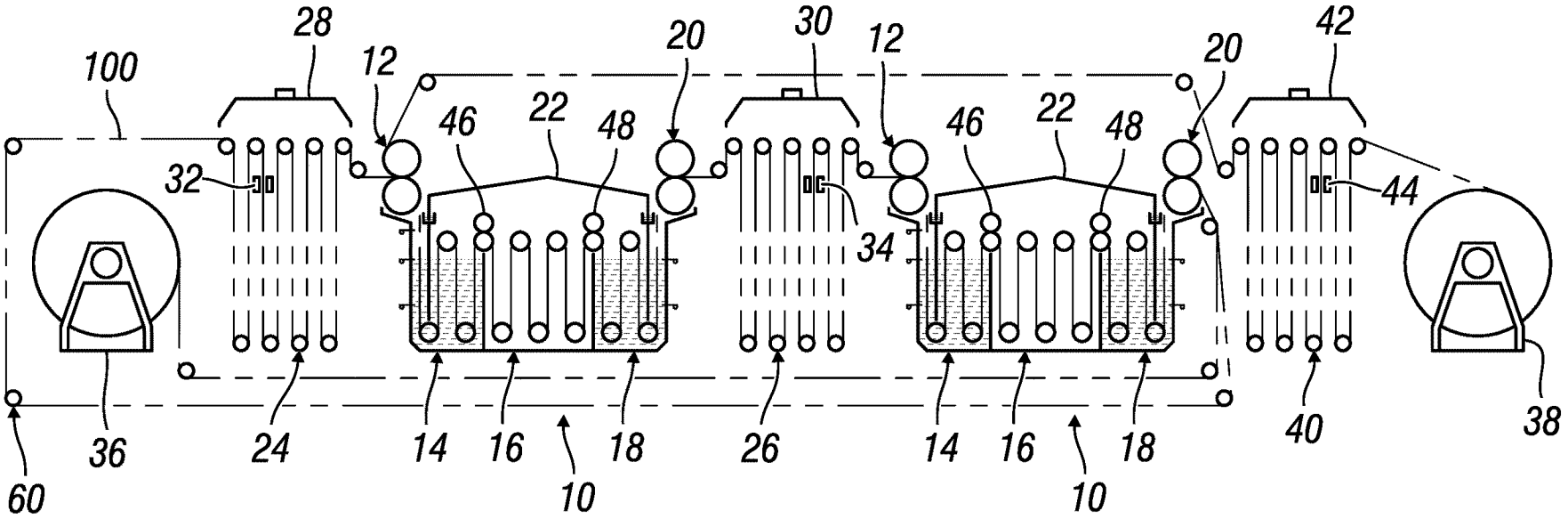
FIG. 1E is a diagrammatical view of the machine in FIG. 1D in which the textile support is immersed so as to operate with more layers superimposed, that is with the "loop" system.
Figure 1F:
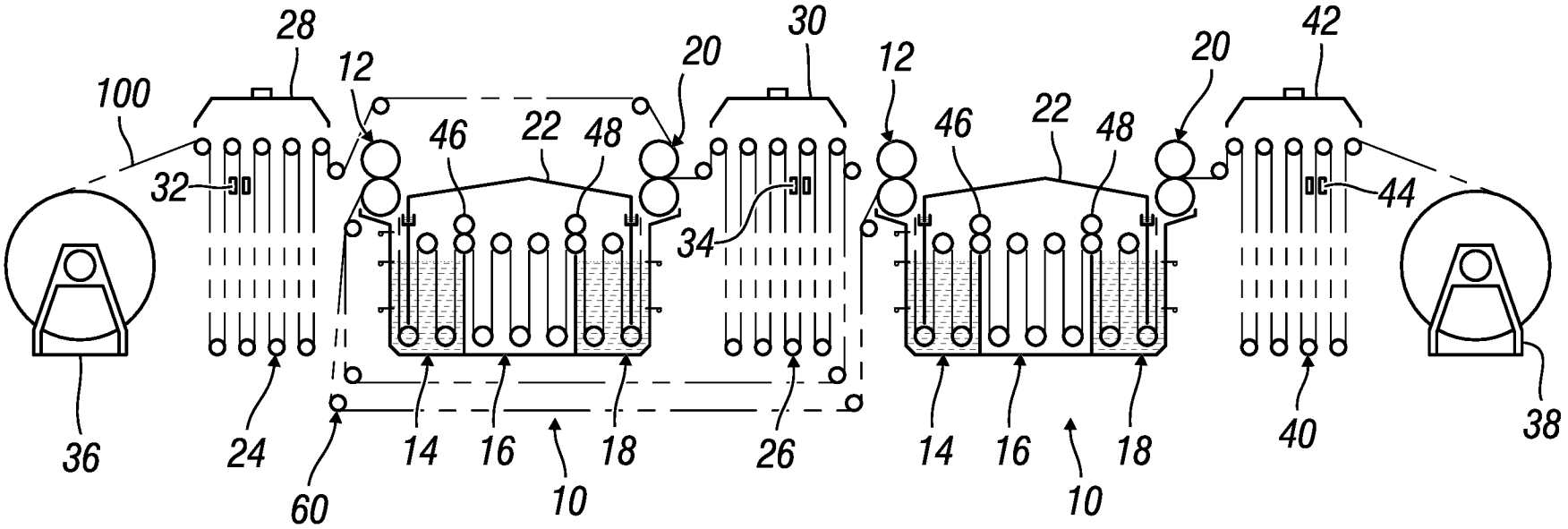
FIG. 1F is a diagrammatical view of the machine in FIG. 1E in which the textile support is placed with the "loop" system in the first tank and in the traditional way in the second tank.
Figure 1G:
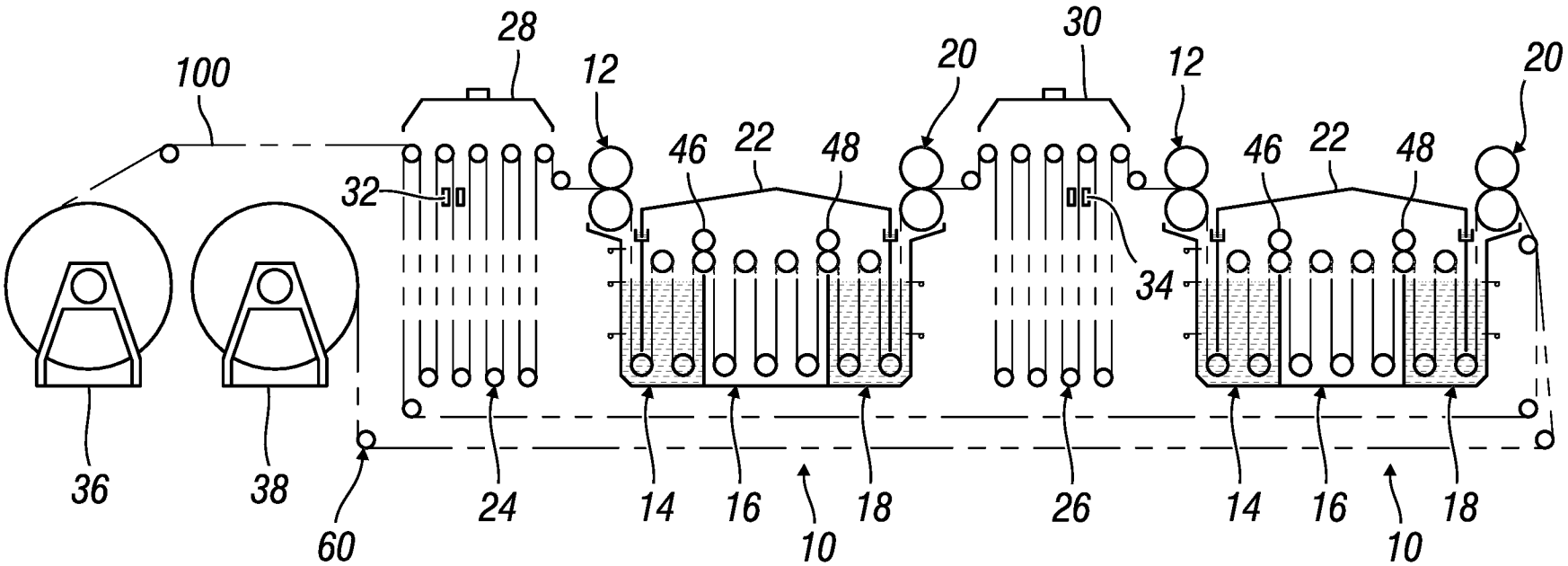
FIG. 1G is a diagrammatical view of the machine in FIG. 1E in the version with a pair of textile support winding/unwinding stations arranged on one side only.

The embodiment in FIG. 1E is the same as FIG. 1D, with only the variant of providing for the system 60 to recirculate the textile support 100 so that such textile support 100 is drawn in as two or more overlapping layers, as in the so-called "loop" system, with the advantage of increasing production capacity. The embodiment in FIG. 1F is the same as in FIG. 1E with the difference that the system 60 for recirculating the textile support 100 drawing in such textile support 100 as two or more overlapping layers is limited to the first multipurpose dyeing module 10, which is therefore intended only for dyeing. The second multipurpose dyeing module 10 is intended for auxiliary operations, thus avoiding the module cleaning operations necessary when changing over a batch. The embodiment in FIG. 1G is the same as in FIG. 1E with the difference that the two motorised stations 36, 38 for winding/unwinding the textile support 100 are arranged on one side only, with the advantage of easy operation and simplification of the path of the textile support 100 in the recirculation system 60.

Figure 1H:
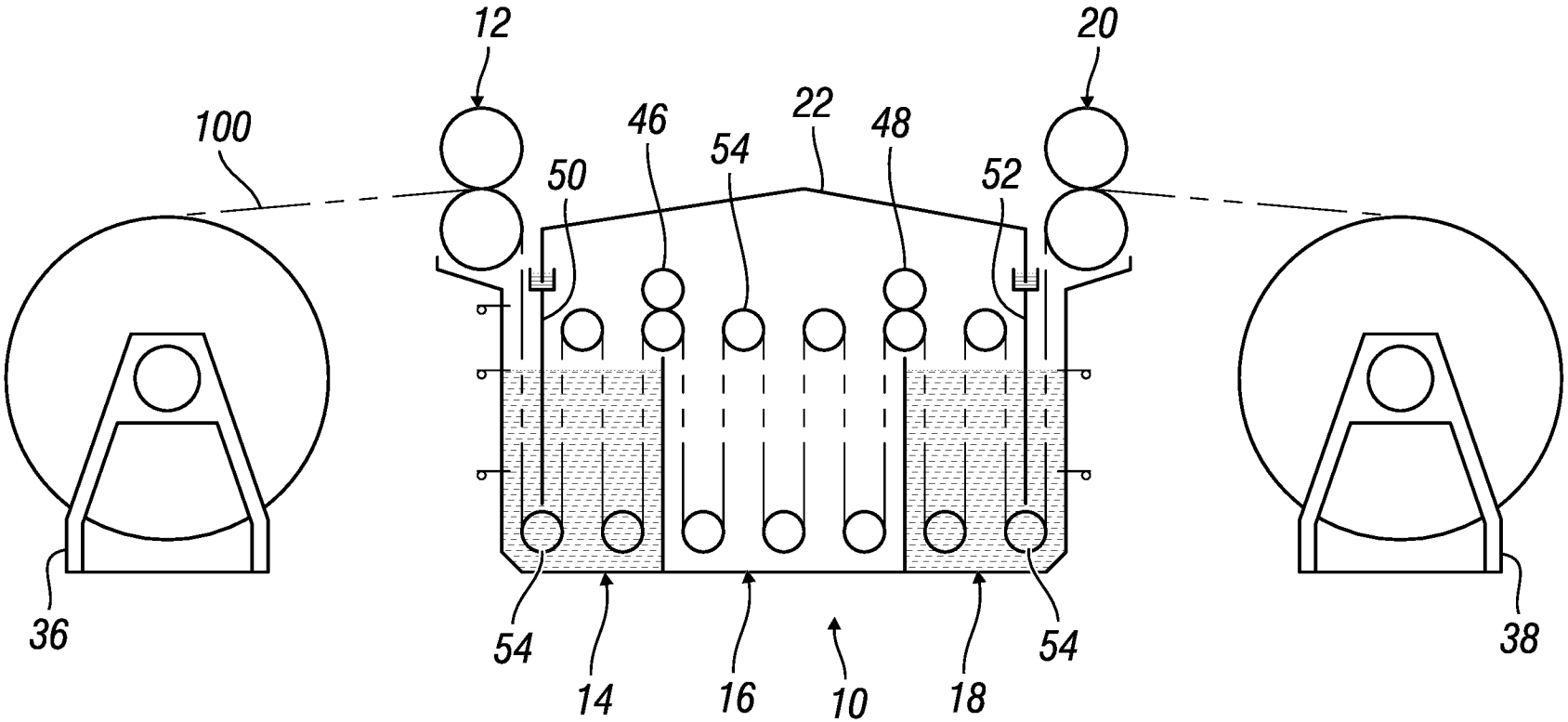

In the embodiment in FIGS. 1H and 1I the multipurpose dyeing machine is constructed in sequence as in FIG. 1A, without however the two lateral groups of oxidation rolls. This simplified version makes it possible to produce a new fabric dyeing machine of the traditional classic type which because of all its special characteristics makes "jiggers" technologically and functionally obsolete.

Regardless of the form of construction, in comparison with traditional "jiggers" the multipurpose dyeing machine according to the present invention is further equipped with:

- two squeezing devices 12, 20, each of which preferably comprises a pair of pneumatic pressure rolls located externally at the ends of a single dyeing module 10, with the possibility of alternating their direction of travel;
- two weight-loaded squeezing devices 46, 48, each comprising a pair of rotating idling rollers between which the fabric or yarn 100 passes, placed inside the dyeing module 10. More specifically, a first squeezing device 46 is interposed between the first treatment tank 14 and the central tank 16, while the second squeezing device 48 is interposed between the central tank 16 and the second treatment tank 18;

the dyeing module 10 has a much longer draw-in and is divided into three watertight compartments, operating in an inert environment, with the possibility of performing two different dyeing operations and/or two treatments at the same time. Also, there is the central tank 16 for diffusion/fixing of the dye in an inert environment between the two treatment tanks 14, 18 located at the two ends of the dyeing module 10. This central tank can also be used as a dyeing or washing tank;

an in-tank hydraulic system for inerting, feeding and alternating adjustment of bath levels in the two treatment tanks 14, 18, circulating the dye bath for use in the two sequential treatment tanks 14, 18, also for different treatments and processes, as well as also using the dye diffusion/fixing tank 16 for dyeing and washing;

at least one group of oxidation rolls 24, 26, 40, placed on each side of a single dyeing module 10 for the oxidation of vat dyes in air. Each group of oxidation rolls 24, 26, 40 is preferably equipped with a corresponding suction hood 28, 30, 42 and a corresponding oxidation intensifier device 32, 34, 44; and at least two motorised stations 36, 38 for the controlled and alternating winding/unwinding of the fabric or yarn 100.

As a consequence, always in comparison with a traditional "jigger", the multipurpose dyeing machine according to the present invention makes it possible to obtain the following operating advantages:

possibility of dyeing with indigo and vat dyes several consecutive times, according to the overdyeing procedure, to intensify of the shade of colour;

possibility of longer lengths of fabric and/or yarn 100 being treated, as the motorised winding/unwinding stations 36, 38 are outside the dyeing module 10, independent of each other and can also be of large diameter;

direct use of rolls of fabric from previous processes, such as: singeing, mercerising, scouring and bleaching;

possibility of differentiating bath/fibre contact times by reducing the bath level in the tanks and/or the length of immersed fabric or yarn, by changing the draw-in, including in the diffusion/fixing area;

dyeing in an inert environment, with unparalleled quality characteristics, exceptional colour rendering, reduction in caustic soda and sodium hydrosulphite consumption, with greater penetration and fixation of the dye, and with a significant saving in wash water;

hitherto unimaginable operating versatility.

Figure 1J:
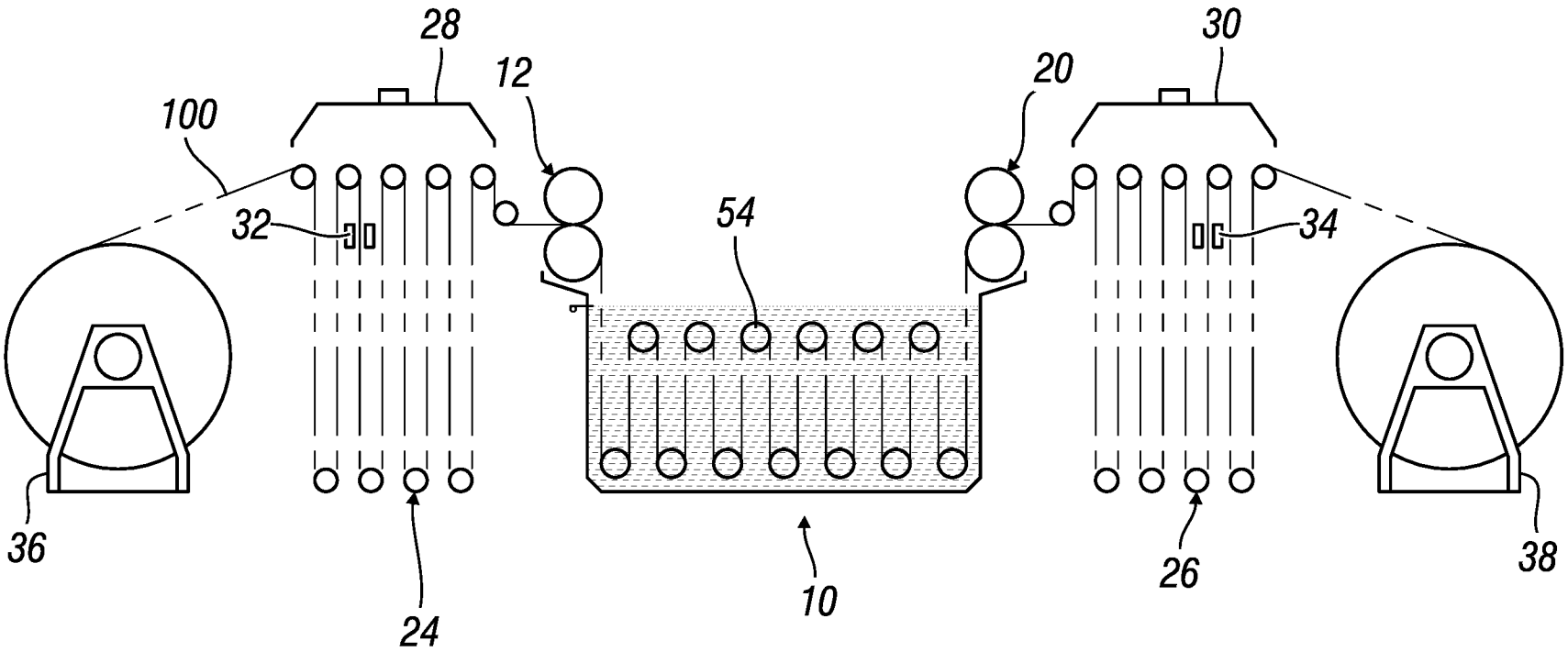
FIGS. 1J and 1K are diagrammatical views of the machine in FIG. 1A with a single treatment volume and without a cover.
Figure 1K:
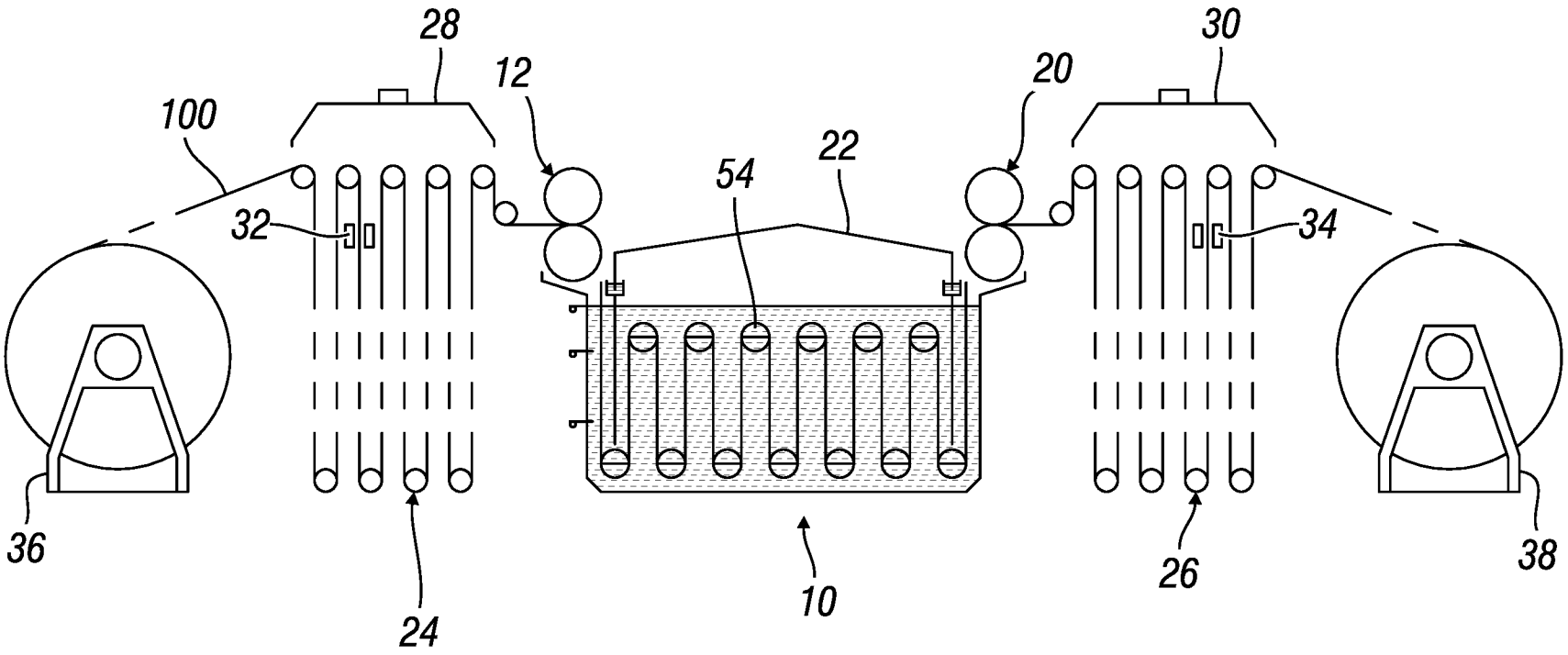

FIGS. 1J and 1K are diagrammatical side views in elevation of the machine in FIG. 1A provided with a single treatment volume and without the covering shell. In other words, in this embodiment the first treatment tank 14, the central tank 16 and the second treatment tank 18 are in fluid communication with each other to form a single treatment volume filled with a single process fluid, typically comprising a dye bath. This solution, working with a single bath at maximum level, i.e. with the upper return rollers 54 and therefore also all of the textile support 100 in the dyeing module 10 covered, makes it possible to dye in air with any dye, but also with indigo and other vat dyes as in traditional continuous dyeing machines.

FIG. 2 shows a single multipurpose dyeing module 10, in the preferred operating version for indigo dyeing and in the stage in which the fabric or yarn 100 is advancing from left to right. In addition to operating in an inert environment, in comparison with a tank for the continuous dyeing of fabrics and/or warp yarns with indigo in air in a traditional plant, this multipurpose dyeing module 10 differs because of:

the division into three watertight compartments (tanks);

the two lateral treatment tanks 14, 18, each of which includes a respective vertical watertight gate 50, 52 to form two hydraulic sealing cavities between the process fluids and the external environment for entry and exit of the belt of fabric and/or yarn 100, without the release of inert gas;

the two vertical watertight gates 50, 52 have a connecting channel at the top between all tanks 14, 16, 18 and the covering shell 22 so as to form a hydraulic seal for such covering shell 22 around the entire perimeter of the multipurpose dyeing module 10;

location of a motorised pneumatic pressure squeezing device 12 outside, upstream of the first treatment tank 14;

possibility for the two squeezing devices 12, 20 to alternate the direction of travel;

location of the respective weight-loaded squeezing devices 46, 48 with idling rotating rollers within the dye diffusion/fixing area, above the vertical walls of the tanks 14, 18;

possibility for the two treatment tanks 14, 18 to operate with high- and low-level bath alternately according to the needs and/or the direction of the forward movement of the textile support 100 being treated, as shown for example in FIGS. 2 and 3;

supplementing it with the hydraulic system 62 for alternating adjustment of the bath levels in the two treatment tanks 14, 18;

supplementing the hydraulic system 62 with the in-tank circulation system shown in detail in FIG. 7, for use of the three tanks 14, 16, 18 in sequence, including for different treatments and processes.

The multipurpose dyeing module 10 in FIG. 8C provides that the textile support 100 being treated is sprayed on both the face and the reverse side by a plurality of foam dyeing solution dispensers 58 located inside one of the three tanks 14, 16, 18, preferably the central tank 16. This dyeing system is one of the most economical and eco-sustainable. Naturally the scope of protection of this invention also includes all the other possible systems of application of vat dye solutions to the fabric and/or yarn, always in an inert environment, such as laminar jets, spraying, atomising, coating, doctoring, etc., and in any event all systems that do not require the fabric and/or yarn to be immersed in the aqueous solutions present in traditional dyeing tanks.

The multipurpose dyeing module 10 in FIG. 9 is configured to operate in an inert environment, with indigo and other vat dyes. In particular, with respect to the embodiments shown in FIGS. 2, 3 and 4, this multipurpose dyeing module 10 operates according to an alternative method of dyeing with indigo dye, i.e. with reduced dipping and diffusion/fixing times, by changing the draw-in.

The multipurpose dyeing module 10 in FIG. 10 operates according to another alternative method for dyeing with indigo dye, i.e. with reduced dipping and diffusion/fixing times and by lowering the upper return rollers 54 without changing the draw-in. The multipurpose dyeing module 10 in FIG. 11 operates according to another alternative method for dyeing with indigo dye, i.e. with reduced dipping and diffusion/fixing times, and by both lowering the upper return rollers 54 and changing the draw-in.

Finally, the multipurpose dyeing module 10 in FIG. 12 operates according to another alternative dyeing method, i.e. with the indigo dye bath, preferably at a low level, in all three tanks 14, 16, 18. In this condition, working with many alternations of dyeing in a bath with a low concentration of indigo dye, dyes with very dark shades and exceptional colour-fastness, characteristic of the famous "Japanese denim", much in demand by the style elite, are obtained. This multipurpose dyeing module 10 adds the new technology of dyeing in an inert environment to the traditional technology of continuous dyeing of fabrics and warp yarns with indigo and other vat dyes in air, in a simple, economical and rational way, with all its strengths and advantages.

It will therefore be seen that the multipurpose dyeing machine with an alternating stage batch system for fabrics and warp yarns according to the present invention has accomplished the objects set out above. The multipurpose dyeing machine with an alternating stage batch system for fabrics and warp yarns, preferably with indigo and other vat dyes, according to the present invention accomplishes the objects mentioned in the preamble of the description. It should be noted that in order to have maximum flexibility in the final result, in terms of ring dyeing and the dye's depth of penetration and fixation, in addition to the known physical/chemical variables, the above machine is also designed to vary the bath-fibre contact time by reducing the level of the dyeing tanks and/or the length of the immersed fabric and/or yarn, by changing the draw-in, including in the diffusion/fixing area. The multipurpose dyeing machine according to the present invention also offers the possibility of dyeing small batches of fabric and yarn, i.e. the small batches of yarn that are increasingly in demand on the market. It should also be noted that, for the sake of simplicity of explanation, both in the preamble and in the description the term 'rolls' has been used indiscriminately for both fabrics and warp yarns. In the case of yarns, it is in fact intended that they may also be presented flat, on one or more reels, bobbins, etc., or as ropes, as one or more "balls", or even in layers, in appropriate containers. The multipurpose dyeing machine with an alternating stage batch system for fabrics and warp yarns according to the present invention conceived in this way is in any event susceptible of numerous modifications and variations, all falling within the same inventive concept; moreover, all details may be replaced by technically equivalent elements. In practice, any materials as well as any shapes and dimensions may be used, depending on technical needs. The scope of protection of the invention is therefore defined by the appended claims.

The invention claimed is:

1. A dyeing machine comprising at least one dyeing module (10) which in turn includes:

a first squeezing device (12) being configured to extract excess liquids from a textile support (100);

a first treatment tank (14) for the textile support (100) coming from said first squeezing device (12), said first treatment tank (14) being located downstream of said first squeezing device (12) and being configured to be at least partly filled with a first process liquid;

a central tank (16), located downstream of the first treatment tank (14) and configured to contain said first process liquid or a second process liquid, for either of the first process liquid and the second process liquid to prevent oxidation of the textile support (100) when dyeing with a diffusion/fixing of a dye in a fibre of said dyed textile support (100), or to operate in air to oxidise said dyed textile support (100);

a second treatment tank (18) for the textile support (100), said second treatment tank (18) being located downstream of the central tank (16) and being configured to be at least partly filled with the same first process liquid that fills the first treatment tank (14), or with another liquid; and a second squeezing device (20) for said textile support (100), located downstream of the second treatment tank (18) and configured to remove excess liquids from said textile support (100), the dyeing machine further comprising:

a hydraulic system (62) to alternately supply, circulate and adjust the levels of the first process liquid and the second process liquid in the two treatment tanks (14, 18) and in the central tank (16) respectively; and motorized stations (36, 38) for moving the textile support (100), the dyeing machine being wherein the first treatment tank (14) and the second treatment tank (18) have the same shape and the same dimensional and capacity characteristics, wherein the first treatment tank (14) and the second treatment tank (18) are symmetrical with respect to a plane of symmetry (P) lying in the central tank (16) and arranged perpendicularly with respect to the direction of the forward movement of the textile support (100), and wherein the motorized stations (36, 38) for moving the textile support (100) are configured to move forward said textile support (100) alternately in both directions, either from the first squeezing device (12) to the second squeezing device (20) sequentially through the first treatment tank (14), the central tank (16) and the second treatment tank (18), or from the second squeezing device (20) to the first squeezing device (12) sequentially through the second treatment tank (18), the central tank (16) and the first treatment tank (14).

2. The machine according to claim 1, wherein the first treatment tank (14), the central tank (16) and the second treatment tank (18) are enclosed by a hermetically sealed upper covering shell (22).

3. The machine according to claim 1, wherein it is provided, on each of two inlet/outlet sides and vice versa for the textile support (100) with respect to the dyeing module (10), with at least one group of rolls (24, 26, 40) for an oxidation of vat dyes in air, wherein there are provided at least one first group of oxidation rolls (24), located at the first squeezing device (12), and at least one second group of oxidation rolls (26), located at the second squeezing device (20), so that the dyeing machine is arranged for alternating stage batch dyeing of fabrics and warp yarns with indigo and other vat dyes in an inert environment.

4. The machine according to claim 3, wherein each group of rolls (24, 26, 40) is provided above with at least one respective suction hood (28, 30, 42).

5. The machine according to claim 3, wherein each group of rolls (24, 26, 40) is equipped with at least one respective oxidation intensifier device (32, 34, 44).

6. The machine according to claim 3, wherein said motorized stations (36, 38) for moving the textile support (100) comprise at least one pair of motorised stations for controlled winding/unwinding of the textile support (100) onto/off the respective rolls.

7. The machine according to claim 6, wherein at least one first motorised winding/unwinding station (36) is located at the first group of oxidation rolls (24) in a position opposite to a position of the first squeezing device (12), while at least one second motorised winding/unwinding station (38) is located at the second group of oxidation rolls (26) in a position opposite to a position of the second squeezing device (20).

8. The machine according to claim 6, wherein there are provided at least two first motorised winding/unwinding stations (36), both located at the first group of oxidation rolls (24) and in a position opposite to a position of the first squeezing device (12), and at least two second motorized winding/unwinding stations (38), both located at the second group of oxidation rolls (26) and in a position opposite to a position of the second squeezing device (20).

9. The machine according to claim 1, wherein said first treatment tank (14) and said second treatment tank (18) are dyeing tanks, said first process liquid comprises a dyeing substance and said textile support (100) may be either a fabric or a yarn.

10. The machine according to claim 9, wherein each of the first dyeing tank (14), the central tank (16) and the second dyeing tank (18) is internally provided with a plurality of return rollers (54) configured to arrange the textile support (100), which is in discontinuous movement, in a plurality of vertical planes parallel to each other, wherein at least some of said return rollers (54) can be moved in a vertical direction to change a drawing of the textile support (100) into the dyeing module (10).

11. The machine according to claim 9, wherein it comprises two weight-loaded squeezing devices (46, 48) each comprising a pair of rotating idling rollers between which the textile support (100) passes, said two squeezing devices (46, 48) being placed inside the dyeing module (10), wherein a first squeezing device (46) is interposed between the first dyeing tank (14) and the central tank (16), while the second squeezing device (48) is interposed between the central tank (16) and the second dyeing tank (18).

12. The machine according to claim 9, wherein the first treatment tank and the second treatment tank each comprise a respective watertight vertical gate (50, 52) to form two hydraulic sealing cavities between the process liquids, wherein said two vertical gates (50, 52) are provided with a connecting channel at the top between all the tanks (14, 16, 18) and the covering shell (22) so as to form a hydraulic seal for said covering shell (22) along the entire perimeter of the dyeing module (10).

13. The machine according to claim 9, wherein the dyeing module (10) is provided with a plurality of foam dye solution dispensers (58) located inside one of the three tanks (14, 16, 18), said plurality of dispensers (58) being arranged to spray a treated textile support (100) on both the face and reverse sides.

14. The machine according to claim 1, wherein said first treatment tank (14), said central tank (16) and said second treatment tank (18) are in mutual liquid communication to form a single treatment volume filled with a single process liquid, comprising a dye bath.

15. The machine according to claim 1, wherein it comprises a system (60) for recirculating the textile support (100), the system includes rollers to draw in said textile support (100) as two or more overlapping layers.

* * * * *